US007860415B2

(12) United States Patent
Tokuyama et al.

(10) Patent No.: US 7,860,415 B2
(45) Date of Patent: Dec. 28, 2010

(54) IMAGE FORMING APPARATUS WITH TONER CONCENTRATION SENSOR

(75) Inventors: Mitsuru Tokuyama, Kizugawa (JP); Kouichi Takenouchi, Tenri (JP); Hiroo Naoi, Nara (JP); Kiyofumi Morimoto, Tenri (JP); Kazuma Hinoue, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 522 days.

(21) Appl. No.: 11/984,429

(22) Filed: Nov. 16, 2007

(65) Prior Publication Data

US 2008/0124108 A1 May 29, 2008

(30) Foreign Application Priority Data

Nov. 29, 2006 (JP) ..... P2006-322488

(51) Int. Cl.
*G03G 15/10* (2006.01)

(52) U.S. Cl. ..... 399/62

(58) Field of Classification Search ..... 399/59, 399/62, 63, 38, 43, 49
See application file for complete search history.

(56) References Cited

U.S. PATENT DOCUMENTS

| | | | | |
|---|---|---|---|---|
| 5,579,091 | A * | 11/1996 | Yamada et al. | 399/59 |
| 6,668,142 | B2 * | 12/2003 | Nakaue et al. | 399/43 |
| 6,947,681 | B2 * | 9/2005 | Ogata | 399/58 |
| 7,430,381 | B2 * | 9/2008 | Takenouchi et al. | 399/55 |
| 7,493,058 | B2 * | 2/2009 | Takeuchi et al. | 399/58 |
| 7,603,046 | B2 * | 10/2009 | Hirayama | 399/27 |
| 2006/0193650 | A1 | 8/2006 | Takenouchi et al. | |

FOREIGN PATENT DOCUMENTS

| | | | | |
|---|---|---|---|---|
| CN | 1828444 | A | | 9/2006 |
| JP | 07230211 | A | * | 8/1995 |
| JP | 2000-056639 | | | 2/2000 |
| JP | 2002-072660 | | | 3/2002 |
| JP | 2003-295601 | | | 10/2003 |
| JP | 2003280355 | A | * | 10/2003 |
| JP | 2004-53744 | A | | 2/2004 |
| JP | 2004053744 | A | * | 2/2004 |
| JP | 2004117734 | A | * | 4/2004 |
| JP | 2006-010749 | | | 1/2006 |
| JP | 2006-65180 | A | | 3/2006 |
| JP | 2006201656 | A | * | 8/2006 |

* cited by examiner

*Primary Examiner*—Robert Beatty
(74) *Attorney, Agent, or Firm*—Nixon & Vanderhye, PC

(57) ABSTRACT

An image forming apparatus includes a toner image forming section including a developing device having a developer tank for storing a two-component developer, a transfer section, a fixing section, a recording medium feeding section, and a discharging section. The image forming apparatus further includes a toner concentration detecting section for detecting the toner concentration in the developer tank, a printing speed switching section, a toner concentration calculating section for correcting a detection result obtained by the toner concentration detecting section according to a speed of printing to calculate the toner concentration, and a toner replenishment control section for replenishing the toner into the developer tank according to a calculation result by the toner concentration calculating section.

13 Claims, 4 Drawing Sheets

IMAGE FORMING APPARATUS WITH TONER CONCENTRATION SENSOR

CROSS-REFERENCE TO RELATED APPLICATION

This application claims priority to Japanese Patent Application No. 2006-322488, which was filed on Nov. 29, 2006, the contents of which are incorporated herein by reference in its entirety.

BACKGROUND OF THE TECHNOLOGY

1. Field of the Technology

The technology relates to an image forming apparatus.

2. Description of the Related Art

Image forming apparatuses embodying electrophotography are nowadays widely used in many fields, since they realize printing a high-definition image on a recording medium with a simple operation. The image forming apparatus comprises, for example, a photoreceptor, a charging section, an exposure section, a developing section, a transfer section, and a fixing section. The photoreceptor has a photosensitive layer thereon. The charging section charges a surface of the photoreceptor to a predetermined polarity and potential. The exposure section forms an electrostatic latent image on the surface of the photoreceptor in a charged state. The developing section develops the electrostatic latent image on the surface of the photoreceptor using a toner to form a toner image. The transfer section transfers the toner image on the surface of the photoreceptor onto a recording medium. The fixing section fixes the toner image onto the recording medium. Through these processes using the respective sections, an image corresponding to image information is formed on the recording medium.

Here, in the developing section, use is made of a developing device including a developing roller for supplying a toner onto the electrostatic latent image on the surface of the photoreceptor to form the toner image, a developer tank for storing a two-component developer containing the toner therein and supplying the two-component developer onto the developing roller, and a toner concentration sensor for detecting a toner concentration in the developer tank. A toner replenishment into the developer tank is controlled in accordance with a detection result of the toner concentration sensor. The toner concentration sensor normally outputs the detection result as a voltage, which voltage has a tendency to be affected by a detecting sensitivity of the toner concentration sensor itself, use environments (temperature, humidity and accumulated number of times printing) for the two-component developer, and the like. For example, the detecting sensitivity of the toner concentration sensor is changed depending on a temperature, humidity, and the like. In addition, the detecting sensitivity of the toner concentration sensor is also changed depending on speed of printing an image, number of times of printing images, and the like in the image forming apparatus. Moreover, in a color image forming apparatus, a detecting result of the toner concentration sensor is also changed depending on color of toner. Therefore, an appropriate amount of toner may not be replenished into the developer tank, causing a decrease in an image concentration, a faint and patchy image, and the like.

In view of the problem of the related art, there is proposed an image forming apparatus comprising, for example, a photoreceptor, a exposure section, a developing section, a toner concentration sensor, a toner replenishment control section, a control section, and a memory section (refer to Japanese Unexamined Patent Publication JP-A 2006-010749, for example). The toner concentration sensor detects a toner concentration in a two-component developer based on permeability of the two-component developer. The toner replenishment control section replenishes a toner to the developing section. The control section controls the toner replenishment control section in accordance with a detection result by the toner concentration sensor. The memory section stores a correction value of a detecting sensitivity depending on number of times of printing based on a fact that the detecting sensitivity of the toner replenishment sensor is changed depending on number of times of printing. According to the image forming apparatus disclosed in JP-A 2006-010749, a voltage outputted from the toner concentration sensor is corrected according to number of times of printing, and depending on the correction value obtained, a toner is replenished to the developing section by the toner replenishment control section. However, the detecting sensitivity of the toner concentration sensor is more affected by a speed of printing than by number of times of printing. Therefore, even though the detecting sensitivity is corrected only by number of times of printing, an appropriate amount of toner cannot be replenished.

In addition, there is proposed an image forming apparatus comprising a toner concentration sensor for detecting a toner concentration in a developer tank based on a change in permeability of a developer, for initializing a detecting sensitivity of a toner concentration sensor using a specific method (refer to Japanese Unexamined Patent Publication JP-A 2006-0566639, for example). According to the specific method, for a two-component developer in a static state or a flowing state to be filled up into a developer tank, a direct-current voltage for adjusting an output operation point of the toner concentration sensor is set to such a value that the output value of the toner concentration sensor is set to a center of an output fluctuation range of the toner concentration sensor, and thereafter the direct-current voltage is further changed from the above-described value by a predetermined amount, during which the output value of the toner concentration sensor is detected. Accordingly, the detecting sensitivity is initialized. A technique disclosed in JP-A 2000-056639 is designed to focus on a change in detecting sensitivity of the toner concentration sensor depending on a bulk density of the developer when the detecting sensitivity of the toner concentration sensor is initialized, to thereby remove an effect of the bulk density of the developer by adopting the above-described method. However, JP-A 2000-056639 relates to initialization of the detecting sensitivity of the toner concentration sensor, and discloses no technical idea for correcting the detecting sensitivity of the toner concentration sensor to be changed over time. This is also evident from, for example, a description that "in the embodiment, it is possible to set variations in a sensor sensitivity of a toner concentration detecting sensor due to its transvariation, its case and bobbin variation, its assembly variation and the like, in a state in which the toner concentration sensor is arranged in a developing container" in lines 1 to 4 in paragraph [0054] of JP-A 2000-056639. That is, JP-A 2000-056639 does not disclose in any way a technical idea in which the detecting sensitivity of the toner concentration detecting sensor is corrected by a change in speed of printing.

SUMMARY OF THE TECHNOLOGY

An object of the technology is to provide an image forming apparatus replenishing a substantially appropriate amount of toner into a developer tank by adjusting a detecting sensitivity of a toner concentration sensor dependently on a speed of printing an image, with the result that occurrence of image failures such as a decrease in an image concentration, and a faint and patchy image is prevented, and a high-concentration and high-definition image is obtained stably over a long term.

The technology provides an image forming apparatus for electrophotographically forming an image, comprising:

an image forming section for printing the toner image on a recording medium to form an image, the image forming section including a photoreceptor having a photosensitive layer for forming an electrostatic latent image on a surface thereof, and a developing device including a developing roller for supplying a toner to the electrostatic latent image on the surface of the photoreceptor to form a toner image, and a developer tank for storing a two-component developer containing a toner;

a toner concentration detecting section for detecting a toner concentration in the developer tank;

a printing speed switching section for switching a speed of printing an image formed by the image forming section;

a toner concentration calculating section for calculating a toner concentration in the developer tank from a detection result by the toner concentration detecting section, according to the speed of printing an image;

a toner replenishment control section for replenishing the toner into the developer tank according to a calculation result by the toner concentration calculating section; and a sensitivity switching section for switching a detecting sensitivity of the toner concentration detecting section depending on the print speed of an image.

Further, it is preferable that the image forming section forms a monochrome image or a color image.

An image forming apparatus, which forms an image using an electrophotographic process, comprises an image forming section, a toner concentration detecting section, a printing speed switching section, a toner concentration calculating section, a toner replenishment control section, and a sensitivity switching section. The image forming section includes a photoreceptor and a developing device, and transfers a toner image to a recording medium to form an image. In addition, the image forming section is capable of forming a monochrome image and a color image. Here, the photoreceptor has the photosensitive layer for forming an electrostatic latent image on a surface thereof. The developing device includes a developing roller for supplying a toner to the electrostatic latent image, and a developer tank for storing a two-component developer. The toner concentration detecting section detects a toner concentration in the developer tank. The printing speed switching section switches a speed of printing an image by the image forming section. The toner concentration calculating section calculates a toner concentration in the developer tank from the detection result by the toner concentration detecting section, according to the speed of printing an image. The toner replenishment control section replenishes a toner into the developer tank according to the calculation result by the toner concentration calculating section. The sensitivity switching section switches the detecting sensitivity of the toner concentration detecting section according to the speed of printing an image.

According to the image forming apparatus, the image forming apparatus adopts a configuration, in which the toner concentration calculating section switches the detecting sensitivity of the toner concentration detecting section according to the speed of printing an image by the image forming section, and also calculates the toner concentration in the developer tank from the detection result by the toner concentration detecting section. More specifically, a data table showing a relationship between speeds of printing and the detecting sensitivities of the toner concentration detecting section is prepared in advance, and based on the data table the detection result by the toner concentration detecting section is corrected to calculate the toner concentration. The calculation result is obtained in consideration of the speed of printing which greatly affects the detecting sensitivity of the toner concentration detecting section. Therefore, the calculation result is nearly an actual toner concentration value in the developer tank. In addition, the data table described above is set with respect to each model of the toner concentration detecting section. Further, it is possible to set the date table described above in view of kinds of toner color. Therefore, regardless of a model of the toner concentration detecting section, a substantially appropriate amount of toner is replenished into the developer tank. Therefore, according to the image forming apparatus, in any image of a monochrome image and a color image, it is possible to prevent occurrence of image failures such as a decrease in an image concentration, and a faint and patchy image, and to form a high-concentration and high-definition image in a stable and long term manner.

Further, it is preferable that the printing speed switching section carries out switching of speed of printing among speed of printing a monochrome image, speed of printing a color image and speed of printing on cardboard.

The printing speed switching section carries out switching of speed of printing among speeds of printing a monochrome image, printing a color image and printing on cardboard. Accordingly, the currently-used speeds of printing are covered, and thereby an appropriate amount of toner is replenished into the developer tank regardless of kinds of a formed image.

It is preferable that the image forming apparatus further comprises a toner concentration correcting section for correcting the calculation result by the toner concentration calculating section.

The image forming apparatus further comprises the "toner concentration correcting section" for correcting the calculation result by the toner concentration calculating section. Accordingly, the toner concentration in the developer tank is obtained in more accurate manner, and thus a more appropriate amount of toner is replenished into the developer tank. By such a toner replenishment in an appropriate amount, a function for charging the toner in the developer tank is sufficiently fulfilled. As a result, a toner offset, which is caused by a charging failure of a toner, a reverse polarity charge of a toner, and a long-term retention of a toner in the developer tank, is prevented, contributing to a decrease in a toner consumption.

Further, it is preferable that the toner concentration correcting section corrects the calculation result by the toner concentration calculating section, based on a data table showing a relationship between detecting sensitivities of the toner concentration detecting section and correction amounts in a correction parameter.

It is preferable that the toner concentration correcting section corrects the calculation result by the toner concentration calculating section, based on a data table showing a relationship between detecting sensitivities of the toner concentration detecting section and correction amounts in a correction parameter. As a correction parameter, a parameter which affects the detecting sensitivity of the toner concentration detecting section except for the speed of printing an image, and/or a parameter which greatly affects an image concentration of an image can be selected. A relationship between correction amounts in such a correction parameter and the detecting sensitivities is obtained, and based on the relationship the toner concentration is corrected. Accordingly, the toner concentration in the developer tank which meets a fact and is based on a relationship with other members, is obtained. Moreover, the image concentration of an image is held in a high level in an appropriate range.

Further, it is preferable that the correction parameter is based on one or two selected from a decreasing amount of a photosensitive layer on a photoreceptor, a relative humidity inside the image forming apparatus and a correction value of toner concentration obtained by process control.

It is preferable that the correction parameters is based on one or two selected from a decreasing amount of a photosensitive layer on a photoreceptor corresponding to a life of the photoreceptor, relative humidity inside the image forming apparatus, and correction value of toner concentration obtained by process control. Among these correction parameters, the relative humidity inside the image forming apparatus affects the detecting sensitivity of the toner concentration detecting section and the image concentration of an image. Moreover, the decreasing amount of the photosensitive layer on the photoreceptor, and the correction value of toner concentration obtained by the process control mainly affects the image concentration of an image.

Further, it is preferable that the image forming apparatus further comprises a rotation distance accumulating section for accumulating a total rotation distance since the developing roller has been started to be used, and a layer decreasing amount calculating section for calculating a decreasing amount of a photosensitive layer on a photoreceptor, according to an accumulation result by the rotation distance accumulating section, and the toner concentration correcting section corrects the detection result by the toner concentration detecting section according to a calculation result by the layer decreasing amount calculating section.

Correction of the toner concentration by the toner concentration correcting section using the decreasing amount of the photosensitive layer on the photoreceptor as a correction parameter is carried out by a configuration including, for example, the rotation distance accumulating section and the layer decreasing amount calculating section. The rotation distance accumulating section accumulates the total rotation distance since the developing roller has been started to be used. The layer decreasing amount calculating section calculates the decreasing amount of the photosensitive layer on the photoreceptor according to the accumulation result by the rotation distance accumulating section. Typically, the developing roller is arranged so as to be spaced having a slight gap in relation to the photosensitive layer on the photoreceptor. Therefore, there is a correlation between the total rotation distance of the developing roller and the decreasing amount of the photosensitive layer on the photoreceptor. Therefore, a data table of this relationship is prepared in advance, and based on this data table and the total rotation distance of the developing roller, the decreasing amount of the photosensitive layer on the photoreceptor is calculated by the layer decreasing amount calculating section in a substantially accurate manner. On the other hand, the toner concentration correcting section determines the correction value based on the calculation result of the decreasing amount of the photosensitive layer on the photoreceptor, and the data table showing the relationship between decreasing amounts of the photosensitive layer on the photoreceptor and detecting sensitivities of the toner concentration detecting section. Therefore, the correction value with high-accuracy is obtained.

It is preferable that the image forming apparatus further comprises a humidity detecting section for detecting a relative humidity therein, and the toner concentration correcting section corrects the detection result by the toner concentration detecting section according to a detection result by the humidity detecting section.

Correction of the toner concentration by the toner concentration correcting section using the relative humidity in the image forming apparatus as the correction parameter is carried out by a configuration including, for example, the humidity detecting section. The humidity detecting section detects the relative humidity in the image forming apparatus. The relative humidity and the detection sensitivity of the toner concentration detecting section have a clear correlation therebetween. Therefore, the toner concentration correcting section determines the correction value based on the data table showing the relationship between the relative humidities and the detection results of the toner concentration detecting section, and thereby the correction value with high-accuracy is obtained.

Further, it is preferable that the image forming apparatus further comprises a patch forming section for controlling the image forming section so as to form a plurality of toner patches on the photoreceptor of which the toner concentrations are continuously changing, and a patch concentration detecting section for detecting patch concentrations which are toner concentrations of the plurality of toner patches formed on the photoreceptor, and the toner concentration correcting section corrects the detection result by the toner concentration detecting section according to a detection result by the patch concentration detecting section.

Correction of the toner concentration by the toner concentration correcting section which uses a correction value of toner concentration obtained by process control is carried out by a configuration including, for example, the patch forming section and the patch concentration detecting section. The patch forming section controls the image forming section so as to form the plurality of toner patches on the photoreceptor of which the toner concentrations are continuously changing. The patch concentration detecting section detects patch concentrations which are the toner concentrations of the plurality of toner patches formed on the photoreceptor. The correction value of toner concentration obtained by process control greatly affects the image concentration of a formed image. Therefore, the toner concentration correcting section determines the correction value based on the data table showing the relationship between the correction values of toner concentration obtained by process control and the detecting sensitivities of the toner concentration detecting section. Accordingly, the correction value is obtained in a substantially accurate manner. In addition, the image concentration of a formed image is stably held in a high level. Further, the toner concentration correction and the correction by the process control are carried at the same time, allowing a correcting operation to be simplified.

BRIEF DESCRIPTION OF THE DRAWINGS

Other and further objects, features, and advantages will be more explicit from the following detailed description taken with reference to the drawings wherein.

DETAILED DESCRIPTION

Figure 1:
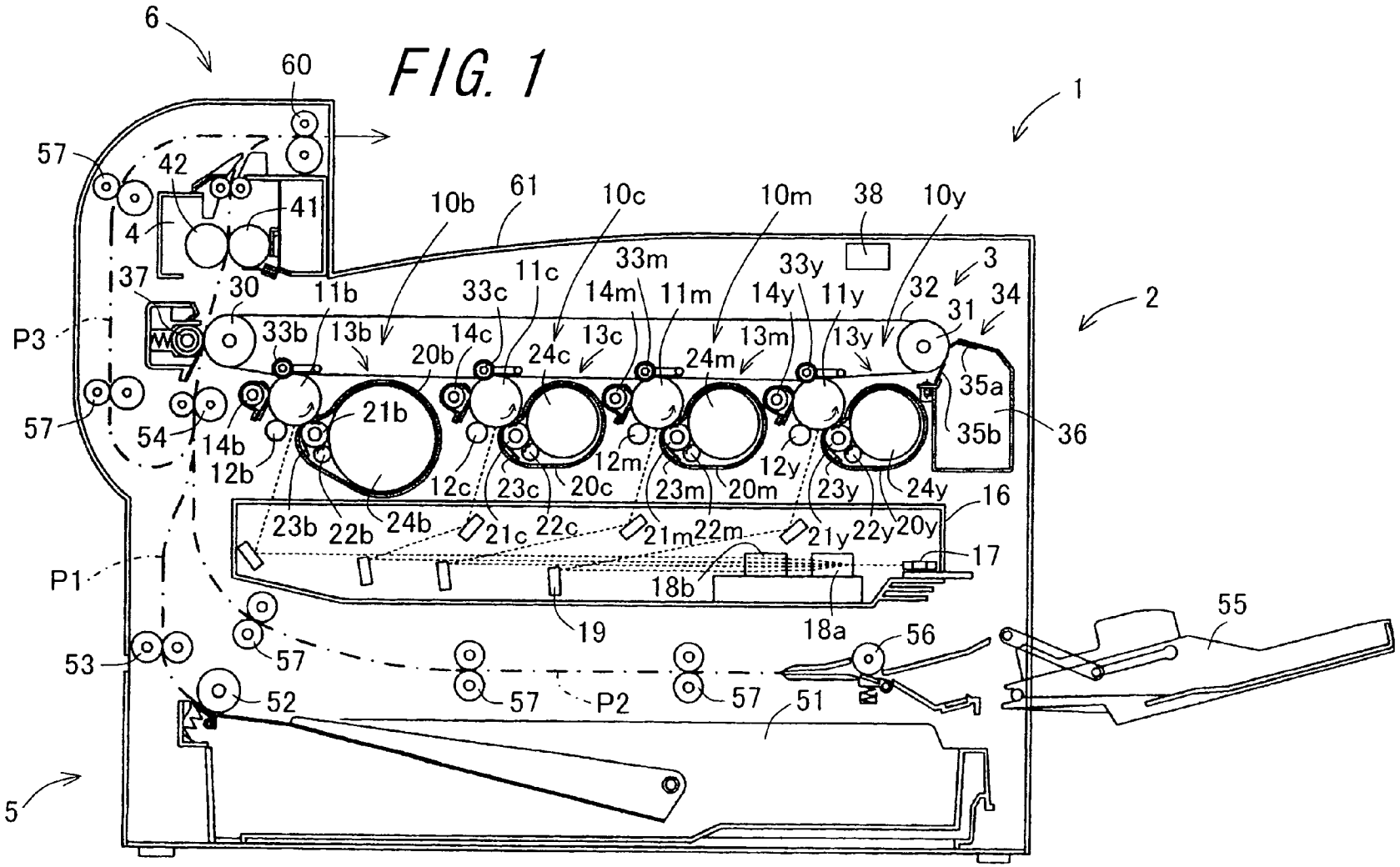
FIG. 1 is a cross-section view schematically illustrating a configuration of an image forming apparatus according to one embodiment.

Hereinafter, referring to the drawings, preferred embodiments are described in detail.

Figure 2:
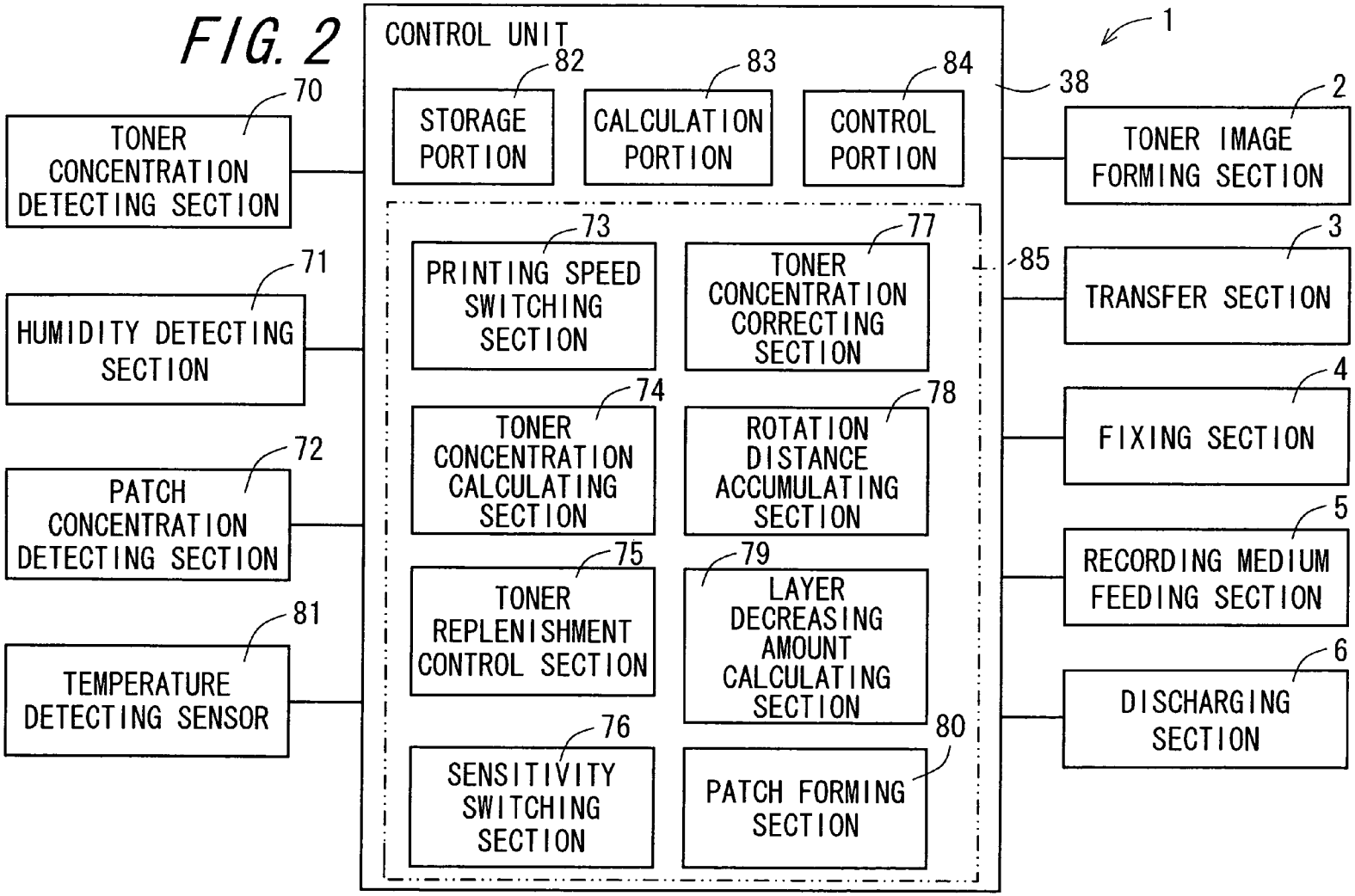
FIG. 2 is a block diagram schematically illustrating an electrical configuration of the image forming apparatus according to one embodiment.

FIG. 1 is a cross-section view schematically illustrating a configuration of an image forming apparatus according to a first embodiment. FIG. 2 is a block diagram schematically illustrating an electrical configuration of the image forming apparatus 1 according to one embodiment. The image forming apparatus 1 is a multifunction printer having a printer function and a facsimile function in combination, in which a full-color or monochrome image is formed on a recording medium depending on image information transmitted. That is, the image forming apparatus 1 has two kinds of modes of printing as a printer mode and a FAX mode, either of which is selected by a control portion 84 in accordance with, for example, an operation input from an operating portion (not shown); and reception of a print job from an external apparatus using a personal computer, a mobile terminal device, a information recording storage medium, and a memory device.

Further, the image forming apparatus 1 has three kinds of modes of printing as a mode of printing a monochrome image, a mode of printing a color image, and a mode of printing on cardboard set thereto. In the mode of printing a monochrome image, a monochrome image is printed at a speed of printing a monochrome image. The speed of printing a monochrome image has the highest speed of the speeds of printing in the three kinds of modes of printing. In the mode of printing a color image, a color image is printed at a speed of printing a color image. The speed of printing a color image is higher than that of the mode of printing on cardboard. In the mode of printing on cardboard, an image is printed on a cardboard at a speed of printing on cardboard. The cardboard is a recording paper having a basis weight of 106 g/m$^2$ to 300 g/m$^2$. The mode of printing on cardboard can be manually set via an operation panel (not shown) provided on an upper side in a vertical direction of the image forming apparatus 1. In the embodiment, it is preferable that a process speed is 255 mm/sec and a speed of printing is 45 sheets/min in the mode of printing a monochrome image (mode of a high-speed printing), a process speed is 167 mm/sec and a speed of printing is 35 sheets/min in the mode of printing a color image (mode of a middle-speed printing), and a process speed is 83.5 mm/sec and a speed of printing is 17.5 sheets/min in the mode of printing on cardboard (mode of a low-speed printing).

The image forming apparatus 1 comprises a toner image forming section 2, a transfer section 3, a fixing section 4, a recording medium supplying section 5, a discharging section 6, and a control unit 38. Among these components, the toner image forming section 2, the transfer section 3, the fixing section 4, the recording medium feeding section 5, and the discharging section 6 correspond to an image forming section. Respective members constituting the toner image forming section 2, and some members included in the transfer section 3 are arranged by four pieces, respectively, in order to correspond to image information of respective colors of black (b), cyan (c), magenta (m), and yellow (y) in color image information. Here, each member of four members corresponding to each of colors is identified by giving an alphabet representing each of colors to an end of a reference numeral, and when four members are collectively designated, they are designated only by a reference numeral.

The toner image forming section 2 includes photoreceptor drums 11, charging sections 12, an exposure unit 16, developing sections 13, and cleaning units 14. The charging sections 12, the developing sections 13, and the cleaning units 14 are arranged in this order around the photoreceptor drums 11 from an upper stream side of a rotation direction of the photoreceptor drums 11.

The photoreceptor drum 11 is a roller-shaped member which is supported so as to be rotated about an axis line thereof by a driving mechanism (not shown), and includes a photosensitive layer which is to have an electrostatic latent image and thus a toner image formed thereon. The photosensitive drum 11 can use a roller-shaped member including, for example, a conductive substrate (not shown) and a photosensitive layer (not shown) formed on a surface of the conductive substrate. As the conductive substrate, there can be used conductive substrates having a cylindrical shape, a columnar shape, and a sheet shape. Among these substrates, preferable is the conductive substrate having a cylindrical shape. As the photosensitive layer, examples thereof include an organic photosensitive layer, and an inorganic photosensitive layer. As the organic photosensitive layer, examples thereof include a laminated body of a charge generating layer as a resin layer containing a charge generating substance, and a charge transporting layer as a resin layer containing a charge transporting substance; and a resin layer containing a charge generating substance and a charge transporting substance in one resin layer. As the inorganic photosensitive layer, examples thereof include a layer containing one or two or more selected from zinc oxide, selenium, and amorphous silicon. An undercoat layer may be disposed between the conductive substrate and the photosensitive layer, and a surface layer (a protective coat) for mainly protecting the photosensitive layer may be provided on a surface of the photosensitive layer.

The charging section 12 is a roller-shaped member provided in pressure-contact with the photoreceptor drum 11. A power supply (not shown) is connected with the charging section 12, and applies a voltage to the charging section 12. The charging section 12 receives a voltage from the power supply, and charges a surface of the photoreceptor drum 11 to a predetermined polarity and potential. In the embodiment, a roller-shaped charging section is, but not exclusively, used, and use can be made of a charging brush type charging device, a charger type charging device, and a saw-tooth type charging device, an ion generation device, and contact type charging devices such as a magnetic brush.

In the exposure unit 16, use is made of a laser scanning unit including an optical irradiating section (not shown), a polygon mirror 17, a first f–θ lens 18*a*, a second f–θ lens 18*b*, and a plurality of reflecting mirrors 19. The exposure unit 16 irradiates a surface of the photoreceptor 11 in a charged state with a signal light beam to form an electrostatic latent image corresponding to image information. The optical irradiating section irradiates with the signal light beam corresponding to the image information. In the light irradiating section, a light source such as a semiconductor laser, and a LED array can be used. A liquid crystal shutter may be used in combination with the light source. The polygon mirror 17 deflects the signal light beam emitted from the optical irradiating section by a constant angular speed rotation thereof. The first f–θ lens 18*a*, and the second f–θ lens 18*b* split the signal beam which has been deflected by the polygon mirror 17 into signal beams corresponding to the respective image information of yellow, magenta, cyan and black, and emit the signal beams at the reflecting mirrors 19 corresponding to the respective colors. The reflecting mirrors 19 reflect the signal beams of the respective colors emitted through the first f–θ lens 18*a* and the second f–θ lens 18*b*, at the photoreceptor drums 11 corresponding to the respective colors. Accordingly, the electrostatic latent images corresponding to the respective colors are formed on the photoreceptor drums 11*y*, 11*m*, 11*c* and 11*b*.

The developing section includes developer tanks 20, developing rollers 21, supplying rollers 22, layer thickness regulating members 23, toner cartridges 24, and toner concentration detecting sections 70.

The developer tank 20 is a container-shaped member disposed so as to face a surface of the photoreceptor drum 11, and is provided with a developer in addition to the developer tank 20, the developing roller 21, the supplying roller 22, the layer thickness regulating member 23, and the toner cartridge 24, in an internal space thereof. Here, as the developer, an one-component developer containing only a toner, and a two-component developer containing a toner and a carrier can be used. In a side of the developer tank 20, which side faces the photoreceptor drum 11, an opening is formed, and through the opening a surface of the photoreceptor drum 11 is opposed to the developing roller 21.

The developing roller 21 is a roller-shaped member which is rotatably supported by the developer tank 20, and is rotated about an axis line thereof by a driving mechanism (not shown). In addition, the developing roller 21 is arranged so that the axis line thereof is in parallel to an axis line of the photoreceptor drum 11. The developing roller 21 bears a developer layer on a surface thereof, supplies a toner to the electrostatic latent image on a surface of the photoreceptor drum 11 in a pressure contact area with the photoreceptor drum 11 (a developing nip portion), and the electrostatic latent image is developed to form a toner image. A power supply (not shown) is connected to the developing roller 21, and when the toner is supplied, electrical potential having a reverse polarity from charged potential of the toner is applied from the power supply to the surface of the developing roller 21 as a developing bias voltage (hereinafter, referred to as simply a "developing bias"). Accordingly, the toner on the surface of the developing roller 21 is smoothly supplied to the electrostatic latent image. Further, by changing a value of the developing bias, an amount of the toner to be supplied to the electrostatic latent image (a toner attaching amount) can be controlled.

The supplying roller 22 is a roller-shaped member which is rotatably supported by the developer tank 20, and is rotated about an axis line thereof by a driving mechanism (not shown). In addition, the supplying roller 22 is arranged so as to be opposed to the photoreceptor drum 11 via the developing roller 21. The supplying roller 22 supplies the developer in the developer tank 20 onto the surface of the developing roller 21 by a rotational drive thereof, and mixes the developer in the developer tank 20 with a toner discharged from the toner cartridge 24 described later. The layer thickness regulating member 23 is a plate member which is arranged so that one end thereof is supported by the developer tank 20 and the other end is in contact with the surface of the developing roller 21. The layer thickness regulating member 23 regulates a thickness of the developer layer on the surface of the developing roller 21.

The toner cartridge 24 is a cylinder-shaped container member which is arranged in a body of the image forming apparatus 1 in a removable manner, and a toner is stored in an internal space thereof. The toner cartridge 24 is arranged so as to be rotated about an axis line thereof by a driving mechanism provided in the image forming apparatus 1. In a side of an axis line direction of the toner cartridge 24, a toner outlet (not shown) extending in the axis line direction is formed, and the toner is discharged from the toner outlet into the developer tank 20 in association with a rotation of the toner cartridge 24. An amount of the toner discharged from the toner cartridge 24 per rotation of the toner cartridge 1 is substantially constant. Therefore, control of a rotation number of the toner cartridge 24 allows a replenishing amount of the toner into the developer tank 20 to be controlled.

The toner concentration detecting section 70 is attached to, for example, a bottom surface of the developer tank on a lower side in a vertical direction of the supplying roller 22, and arranged so that a sensor surface thereof is exposed to an inside of the developer tank 20. The toner concentration detecting section 70 is electrically connected to the control unit 38. The toner concentration detecting sections 70 are arranged in toner image forming sections 2*y*, 2*m*, 2*c* and 2*b*, respectively. The control units 38 allow the toner cartridges 24*y*, 24*m*, 24*c* and 24*b* to rotate according to a detection result by the toner concentration detecting section 70, and control so as to replenish a toner into the developer tanks 20*y*, 20*m*, 20*c* and 20*b*, respectively. A typical toner concentration detecting sensor may be used for the toner concentration detecting section 70, and examples thereof include a transmitted light detecting sensor, a reflected light detecting sensor, and a permeability detecting sensor. Among these sensors, preferable is the permeability detecting sensor. A power supply (not shown) is connected to the permeability sensor. The power supply applies a driving voltage for driving the permeability sensor, and a control voltage for outputting a detection result of the toner concentration to the control unit 38, to the permeability detecting sensor. The control unit 38 controls the power supply to apply the voltages to the permeability detecting sensor. The permeability detecting sensor is a type of sensor for outputting a detection result of the toner concentration as an output voltage value in response to application of the control voltage, and basically has good sensitivity in a vicinity of a middle value of the output voltage. Therefore, this sensor is used in such a way that a control voltage capable of obtaining the output voltage around the middle value is applied. Such a type of permeability detecting sensor is commercially available, and examples thereof include a TS-L, a TS-A, and a TS-K (all trade names, manufactured by TDK corporation). Incidentally, the toner concentration detecting section 70 is arranged so that detecting sensitivity can be switched according to a speed of printing. More specifically, when the speed of printing is switched by a printing speed switching section 73 described later, the toner concentration detecting section 70 is controlled to allow a sensitivity switching section 76 to switch the detecting sensitivity, accordingly.

The cleaning unit 14 removes a residual toner remaining on a surface of the photoreceptor drum 11 to clean up the surface of the photoreceptor drum 11, after a toner image has been transferred onto an intermediate transfer belt 32 described later. As the cleaning unit 14, use is made of a unit including, for example, a cleaning blade, a first waste toner storage tank, and a waste toner transporting roller. The cleaning blade is a plate member in which one end of a short side direction is in contact with the surface of the photoreceptor drum 11, and the other end thereof is supported by the first waste toner storage tank, and it scrapes a residual toner remaining on the surface of the photoreceptor drum 11. The first waste toner storage tank is a container-shaped member in which the cleaning blade and the waste toner transporting roller are provided in the internal space, and a toner scraped by the cleaning blade is temporarily stored. The waste toner transporting roller is a roller-shaped member which is rotatably supported by the toner storage tank, and is arranged so as to be rotated about an axis line thereof by a driving mechanism (not shown). The rotational drive of the waste toner transporting roller transports a toner in the waste toner storage tank to a waste toner tank (not shown) through a toner transporting pipe (not shown) connected to the first waste toner storage tank, and the toner is stored in the waste toner tank. The waste toner tank is replaced with a new one when filled with the toner.

Further, in the embodiment, a humidity detecting section 71 is provided in the toner image forming section 2, preferably, in a vicinity of the developing section 13, which section detects humidity around the developing section 13. The humidity detecting section 71 is electrically connected to the control unit 38, and a detection result thereby is inputted into the control unit 38. As the humidity detecting section 71, a typical humidity sensor can be used, and a temperature and humidity sensor may be used. In the embodiment, as the humidity detecting section 71, a button type temperature and humidity recorder (trade name: Hygrochron, manufactured by KN Laboratories, Inc.) is used. A replenishing amount of a toner is corrected according to a detection result by the humidity detecting section 71.

Further, in the embodiment, a patch concentration detecting section 72 is arranged from a down stream side of the developing section 13 to an upstream side of an intermediate transfer nip portion in a rotation direction of the photoreceptor drum 11. The patch concentration detecting section 72 detects a toner concentration (a patch concentration) of a toner patch to be formed on the surface of the photoreceptor drum 11 by a patch forming section 80 described later. In addition, the patch concentration detecting section 72 is electrically connected to the control unit 38 of the image forming apparatus 1, and outputs a detection result thereby to the control unit 38. The control unit 38 controls the toner concentration of a toner image to be formed by the toner image forming section 2 according to a detection result by the patch concentration detecting section 72. This control is carried out by, for example, changing a developing bias voltage. In addition, the toner concentration can be controlled also by adjusting a charge voltage of the photoreceptor drum 11, an exposure voltage by the exposure unit 16, or the like. As the patch concentration detecting section 72, likewise with respect to the toner concentration detecting section 20, use can be made of typical toner concentration detecting sensors such as a transmitted light detecting sensor, a reflected light detecting sensor, and a permeability detecting sensor.

According to the toner image forming section 2, the surface of the photoreceptor drum 11 in an evenly charged state by the charging section 12 is irradiated from the exposure unit 16 with a signal light beam corresponding to image information and thereby an electrostatic latent image is formed, and a toner is supplied from the developing section 13 onto the electrostatic latent image and thereby a toner image is formed, and the toner image is transferred onto the intermediate transfer belt 32, and then the residual toner remaining on the surface of the photoreceptor drum 11 is removed by the cleaning unit 14. This series of toner image forming operations are repeatedly implemented.

The transfer section 3 includes a driving roller 30, a driven roller 31, a intermediate transfer belt 32, intermediate transfer rollers 33 (*b, c, m, y*), a transfer belt cleaning unit 34, and a transfer roller 37, and is arranged above the photoreceptor drums 11.

The driving roller 30 is a roller-shaped member which is rotatably arranged by a supporting section (not shown), and is arranged so as to be rotated about an axis line thereof by a driving mechanism. The rotational drive of the driving roller 30 allows the intermediate transfer belt 32 to be rotated. In addition, the driving roller 30 is in pressure-contact with the transfer roller 37 via the intermediate transfer belt 32. A pressure contact area between the driving roller 30 and the transfer roller 37 is a transfer nip portion. The driven roller 31 is a roller-shaped member which is rotatably arranged by a supporting section (not shown). The driven roller 31 is driven and rotated in association with a rotation of the intermediate transfer belt 32. The driven roller 31 applies appropriate tension to the intermediate transfer belt 32 to support a smooth rotational drive of the intermediate transfer belt 32.

The intermediate transfer belt 32 is an endless belt-shaped member which is suspended in a tensioned state by the driving roller 30 and the driven roller 31, thus forms a moving path having a looped shape, and is rotated by a rotational drive of the driving roller 30. When the intermediate transfer belt 32 passes through the photoreceptor drums 11 while contacting the photoreceptor drums 11, a transfer bias having an opposite polarity from a charge polarity of a toner on the surface of the photoreceptor drum 11 is applied from the intermediate transfer roller 33 which is arranged opposite to the photoreceptor drum 11 via the intermediate transfer belt 32, and a toner image formed on the surface of the photoreceptor drum 11 is transferred onto the intermediate transfer belt 32. In a case of a full-color image, the toner images having respective colors which are formed on the respective photoreceptor drums 11 are sequentially superimposed and transferred onto the intermediate transfer belt 32, and thereby a full-color toner image is formed.

The intermediate transfer roller 33 is a roller-shaped member which is in pressure-contact with the photoreceptor drum 11 via the intermediate transfer belt 32, and is arranged so as to be rotated about an axis line thereof by a driving mechanism (not shown). The intermediate transfer roller 33 has a power supply (not shown) which applies the transfer bias connected as described above, and has a function for allowing the toner image on the surfaces of the photoreceptor drum 11 to be transferred onto the intermediate transfer belt 32. A pressure contact area between the intermediate transfer roller 33 and the photoreceptor drum 11 is an intermediate transfer nip portion.

The transfer belt cleaning unit 34 includes transfer belt cleaning blades 35*a* and 35*b*, and a second waste toner storage tank 36. The transfer belt cleaning blades 35*a* and 35*b* are plate members which are arranged so that one end thereof in a short side direction is in contact with a surface of the intermediate transfer belt 32, and the other end is supported by the second waste toner storage tank 36, respectively, and so as to be opposed to each other. The transfer belt cleaning blades 35*a* and 35*b* scrape and collect a toner, paper dust, and the like remaining on the surface of the intermediate transfer belt 32. The second waste toner storage tank 36 temporarily stores the toner, the paper dust, and the like scraped by the transfer belt cleaning blades 35*a* and 35*b*.

The transfer roller 37 is a roller-shaped member which is in pressure-contact with the driving roller 30 via the intermediate transfer belt 32 by a pressure contact section (not shown), and is arranged so as to be rotated about an axis line thereof by a driving mechanism (not shown). In the transfer nip portion, the toner image which is borne and transported by the intermediate transfer belt 32 is transferred onto a recording medium which is fed from the recording medium feeding section 5 described later. The recording medium bearing the toner image is fed to the fixing section 4. According to the transfer section 3, the toner image which is transferred from the photoreceptor drum 11 to the intermediate transfer belt 32 is transported to the transfer nip portion by a rotational drive of the intermediate transfer belt 32, and transferred onto the recording medium therein.

The fixing section 4 includes a fixing roller 41 and a pressure roller 42, and is a roller-shaped member which is arranged on a downstream side in a feeding direction of the recording medium with respect to the transfer section 3. The fixing roller 41 is arranged so as to be rotated about an axis line thereof by a driving mechanism (not shown), and heats and fuses a toner constituting an unfixed toner image which is borne by the recording medium, to fix it onto the recording medium. The fixing roller 41 is provided with a heating section (not shown) therein. The heating section heats the fixing roller 41 so that a surface of the fixing roller 41 reaches a predetermined temperature (a heating temperature). As the heating section, for example, an infra-red heater, and a halogen lamp may be used. A surface temperature of the fixing roller 41 is maintained at a temperature which is set upon a design of the image forming apparatus 1. The surface temperature of the fixing roller 41 is controlled using, for example, the control unit 38 of the image forming apparatus 1, and a temperature detecting sensor 81 which is arranged adjacent to the surface of the fixing roller 41, for detecting the surface temperature of the fixing roller 41. The temperature detecting sensor 81 is electrically connected to the control unit 38, and a detection result by the temperature detecting sensor 81 is outputted to the control unit 38. The control unit 38 compares the detection result by the temperature detecting sensor 81 with the set temperature. When the detection result is lower than the set temperature, the control unit sends a control signal to a power supply (not shown) which applies a voltage to the heating section, and accelerates a heat generation of the heating section to increase the surface temperature.

The pressure roller 42 is arranged in pressure-contact with the fixing roller 41, and is supported so as to be rotated by a rotational drive of the pressure roller 42. A pressure contact area between the fixing roller 41 and the pressure roller 42 is a fixing nip portion. The pressure roller 42 aids the toner image to be fixed onto the recording medium by pressing the toner and the recording medium when the toner is fused and fixed onto the recording medium by the fixing roller 41. Inside the pressure roller, the heating section such as an infra-red heater and a halogen lamp may be provided. According to the fixing section 4, when the recording medium having the toner image transferred in the transfer section 3 passes through the fixing nip portion while being held by the fixing roller 41 and the pressure roller 42 in a nipped manner, the toner image is pressed under heat onto the recording medium, and is thereby fixed onto the recording medium to form an image.

The recording medium feeding section 5 includes a paper feeding tray 35, pickup rollers 52 and 56, transporting rollers 53 and 57, registration rollers 54, and a manual paper feeding tray 55. The paper feeding tray 51 is a container-shaped member which is arranged in a lower part in a vertical direction of the image forming apparatus 1, for storing the recording medium. Examples of the recording medium include a sheet of regular paper, a sheet of color copy paper, an overhead projector sheet, and a postcard. Examples of a size of the recording medium include A3, A4, B4 and B5. The pickup rollers 52 are roller-shaped members for picking up the recording media stored in the paper feeding tray 51 sheet by sheet and feeding it to a paper transporting path P1. The transporting rollers 53 are a pair of roller members which are arranged in pressure-contact with each other, and transport the recording medium toward the registration rollers 54. The registration rollers 54 are a pair of roller members which are arranged in pressure-contact with each other, and feed the recording medium fed from the transporting rollers 53 to the transfer nip portion, while the toner image borne by the intermediate transfer belt 32 is transported to the transfer nip portion. The manual paper feeding tray 55 is a device for taking the recording medium into the image forming apparatus 1 by a manual operation. The pickup roller 56 is a roller-shaped member for feeding the recording medium which has been taken from the manual paper feeding tray 55 into the image forming apparatus 1, to a paper transporting path P2. The paper transporting path P2 is connected to the paper transporting path P1 on an upstream side of a transporting direction of the recording medium. The transporting rollers 57 are a pair of roller members which are arranged in pressure-contact with each other, for feeding the recording medium which has been taken into the paper transporting path P2 to the registration rollers 54 through the paper transporting path P1.

The discharging section 6 includes paper discharging rollers 60, a discharging tray 61, and a plurality of transporting rollers 57. The paper discharging rollers 60 are roller-shaped members which are arranged on a downstream side in a paper feeding direction with respect to the fixing nip portion, in pressure-contact with each other. In addition, the paper discharging rollers 60 are arranged so as to be rotated in forward and reverse directions by a driving mechanism (not shown). The paper discharging rollers 60 discharge the recording medium having an image formed in the fixing section 4 to the discharging tray 61 which is arranged on an upper surface in a vertical direction of the image forming apparatus 1. In addition, the paper discharging rollers 60 once hold in a nipped manner the recording medium which has been discharged from the fixing section 4 and feed it toward a paper transporting path P3, when a print instruction of a both side printing is inputted into the control unit 38 of the image forming apparatus 1. The paper transporting path P3 is connected to the paper transporting path P1 on an upstream side of a transporting direction of the recording medium. The plurality of transporting rollers 57 are arranged along the paper transporting path P3, and transport the recording medium having one side printed which has been fed to the paper transporting path P3 by the paper discharging roller 60, to the registration rollers 54 on the paper transporting path P1.

The image forming apparatus 1 includes the control unit 38. The control unit is arranged, for example, in an upper part of an internal space of the image forming apparatus 1, and includes a storage portion 82, a calculation portion 83, and a control portion 84. To the storage portion 82 of the control unit 38, there are inputted various kinds of setting values via an operation panel disposed on an upper surface of the image forming apparatus 1, detection results from sensors disposed at various positions inside the image forming apparatus 1, image information from an external device, a data table for carrying out various kinds of control, and the like. Moreover, programs for carrying out various kinds of function elements 85 are stored therein. Examples of the various kinds of function elements 85 include the printing speed switching section 73, a toner concentration calculating section 74, a toner replenishment control section 75, the sensitivity switching section 76, a toner concentration correcting section 77, a rotation distance accumulating section 78, a layer decreasing amount calculating section 79, and the patch forming section 80. As the storage portion 82, memory devices commonly used in this field may be used, and examples thereof include a read only memory (ROM), a random access memory (RAM), and a hard disk drive (HDD). As the external apparatus, electrical or electronic apparatuses capable of forming or obtaining image information, and capable of electrically connecting the image forming apparatus 1 may be used, and examples thereof include a computer, a digital camera, a TV set, a video recorder, a DVD recorder, a HDVD, a blue-ray disk recorder, a facsimile, and a mobile terminal. The calculation portion 83 takes out various kinds of data (an image forming instruction, a detection result, image information, etc.) stored in the storage portion 82, and programs to carry out the various kinds of function elements 85, and makes various kinds of determinations. The control portion 84 sends a control signal to a corresponding device according to the determination result by the calculation portion 83 to carry out operation control. The control portion 84 and the calculation portion 83 include a processing circuit realized by a microcomputer and a microprocessor having a Central Processing Unit (CPU). The control unit 38 includes a power supply in addition to the above-described processing circuit, and the power supply supplies power not only to the control unit 38, but to the respective devices inside the image forming apparatus 1.

In the image forming apparatus 1, a toner replenishment from the toner cartridge 24 to the developer tank 20 is carried out using, for example, the toner concentration detecting section 70, the printing speed switching section 73, the toner concentration calculating section 74, and the toner replenishment control section 75. In the embodiment, a permeability detecting sensor is used as the toner concentration detecting section 70. Further, in the embodiment, a reference toner concentration in the developer tank 20 is stored in the storage portion 82 of the control unit 38. The reference toner concentration is set upon a design of the image forming apparatus 1. Moreover, there is stored in advance a first data table showing a relationship between a detection result by the toner concentration detecting section 70 (an output voltage value, hereinafter, referred to as a "concentration detection result") and a toner concentration in the developer tank 20, at a speed of printing a monochrome image which is widely used in the image forming apparatus 1. Specifically, an actual output value (volt) of the permeability detecting sensor for each toner concentration is measured, and then a relationship between the toner concentrations and the actual output values (volt) of the permeability detecting sensor is obtained. The actual output value is subjected to an analog-digital conversion (hereinafter, referred to as an "AD conversion") into 0 to 255 (8 bits). Then, in addition, there is stored in advance a second data table which is a correction table for converting a concentration detection result at a speed of printing a color image into a concentration detection result at a speed of printing a monochrome image. Furthermore, there is stored in advance a third data table which is a correction table for converting a concentration detection result at a speed of printing on cardboard into a concentration detection result at a speed of printing a monochrome image. The first to third data tables correspond to data with respect to each color of black (b), magenta (m), cyan (c), and yellow (y), respectively. In addition, the first to third data tables are set with respect to each model of the image forming apparatuses and/or each model of the toner concentration detecting sections 70.

As described above, the toner concentration detecting sections 70 are arranged in the developer tanks 20*b*, 20*m*, 20*c*, and 20*y*, respectively, detect the toner concentrations in the developer tanks 20, and output the detection results to the control unit 38 as a voltage value. The output voltage value from the toner concentration detecting section 70 is stored in the storage portion 82 of the control unit 38. The detection by the toner concentration detecting section 70 is continuously carried out, for example, since a print instruction has been inputted into the control unit 38 until an image forming operation is completed at a predetermined time interval. In addition, during start-up of the image forming apparatus 1, the toner concentration in the developer tank 20 is detected by the toner concentration detecting section 70. Incidentally, a detecting sensitivity of the toner concentration detecting section 70 can be switched to a detecting sensitivity corresponding to the print speed according to the speed of printing switched by the printing speed switching section 73. For example, when the speed of printing is a speed of printing a monochrome image, a gradient of the output values of the toner concentration detecting sensor to the toner concentrations of the developer is increased, thus providing the highest detecting sensitivity. Here, the gradient is a gradient of an approximate straight line which is obtained by plotting on a vertical axis (a Y axis) and a horizontal axis (an X axis) with respect to a relationship between the toner concentrations of the developer and the output values of the toner concentration detecting sensor. The gradient is similarly defined with respect to the speed of printing a color image and the speed of printing on cardboard. In addition, the approximate straight line is a straight line obtained by linear regression using a least-square method. In addition, when the speed of printing is the speed of printing on cardboard, a gradient of the output values of the toner concentration detecting sensor to the toner concentrations of the developer is decreased, and thus the detecting sensitivity is controlled so as to be the lowest value. The detecting sensitivity is controlled by the control unit 38, in accordance with the speed of printing switched by the printing speed switching section 73. There is obtained a first proportional constant $k_1$ showing a correlation between the gradient of the output values in the speed of printing a monochrome image and the gradient of the output values at the speed of printing a color image, and there is obtained a second proportional constant $k_2$ showing a correlation between the gradient of the output values at the speed of printing a monochrome image and the gradient of the output values at the speed of printing on cardboard. Intervals between the detecting operations by the toner concentration detecting section 70 can be appropriately changed according to the speed of printing. For example, the intervals between the detecting operations should be decreased down to the shortest at the speed of printing a monochrome image, and the intervals between the detecting operations should be increased up to the longest at the speed of printing on cardboard.

The printing speed switching section 73 reads the speed of printing from print information included in the print instruction inputted to the control unit 38 to switch the speed of printing. The speeds of printing include the speed of printing a monochrome image (a high-speed), the speed of printing a color image (a middle-speed) and the speed of printing on cardboard (a low-speed). More specifically, the printing speed switching section 73 sends a control signal to each member necessary for switching the speed of printing via the control portion 84 of the control unit 38 according to a reading result of the speed of printing, and controls an operation speed (a process speed) of each member in addition to the speed of printing. In addition, the reading result by the printing speed switching section 73 is inputted into the storage portion 82. The reading results inputted into the storage portion 82 are at least a previous reading result and a current reading result. Every time a new reading result is inputted, a last-but-one reading result may be deleted. When a new reading result is inputted, the new reading result is replaced with the current reading result. It can be determined whether the speed of printing is changed or not, by comparing the previous reading result with the current reading result.

The sensitivity switching section 76 switches the detecting sensitivity of the toner concentration detecting section 70 according to the speed of printing which is switched by the printing speed switching section 73. In a case of the permeability detecting sensor used in the embodiment, the detecting sensitivity can be switched by controlling a control voltage value to be applied to the sensor. Reference control voltage values for the respective 4 colors corresponding to the three kinds of speed of printing are determined and inputted into the storage portion 82, with respect to each model of the sensors. From the storage portion 82, the sensitivity switching section 76 takes out the speed of printing which has been switched, and further takes out the reference control voltage corresponding to the speed of printing. Based on the reference control voltage, the sensitivity switching section 76 sends a control signal to a power supply for applying the control voltage to the permeability detecting sensor, to control so as to apply the predetermined control voltage to the permeability detecting sensor.

The toner concentration calculating section 74 calculates the toner concentration in the developer tank 20 from a concentration detection result according to the speed of printing which is switched by the printing speed switching section 73. When the speed of printing is the speed of printing a monochrome image, the toner concentration calculating section takes out the concentration detection result and the first data table from the storage portion 82 to compare them, and obtains the toner concentration corresponding to the concentration detection result using the first data table as the toner concentration in the developer tank 20. When the speed of printing is the speed of printing a color image, the toner concentration calculating section 74 first takes out the concentration detection result and the second data table from the storage portion 82 to obtain the corrected concentration detection result from the second data table. This corrected concentration detection result is stored in the storage portion 82. Next, the toner concentration calculating section takes out the corrected concentration detection result and the first data table to compare them, and obtain the toner concentration corresponding to the corrected concentration detection result using the first data table as the toner concentration in the developer tank 20. When the speed of printing is the speed of printing on cardboard, the toner concentration in the developer tank 20 is obtained likewise with respect to the procedures at the speed of printing a color image, except that the third data table is used in place of the second data table. The calculation result by the toner concentration calculating section 74 is inputted into the storage portion 82.

The toner replenishment control section 75 controls a toner replenishment into the developer tank 20 in accordance with the calculation result by the toner concentration calculating section 74 (hereinafter, referred to as a "concentration calculation result"). The toner replenishment control section 75 first takes out the concentration calculation result and the reference toner concentration in the developer tank 20 from the storage portion 82 to compare them. When the concentration calculation result is below the reference toner concentration, a difference between the reference toner concentration and the concentration calculation result is calculated, and then toner replenishment amount is calculated from the difference, and then a rotation number of the toner cartridge 24 is obtained from the toner replenishment amount obtained. When the toner replenishment amount includes a fraction less than a toner amount which is discharged by one rotation of the toner cartridge 24, the fraction is determined as one rotation by rounding up the toner replenishment amount. The toner replenishment control section 75 sends a control signal to a driving mechanism (not shown, including a power supply for supplying a driving power to the driving mechanism) for rotating the toner cartridge, and allows the toner cartridge 24 to rotate at a predetermined number. Accordingly, a substantially appropriate amount of toner is replenished into the developer tank 20. When the toner replenishment amount is only a fraction less than a toner amount which is discharged by one rotation of the toner cartridge 24, the toner replenishment may be stopped and controlled so that the toner concentration detection by the toner concentration detecting section 70 is advanced.

In the embodiment, the concentration calculation result can be corrected by the toner concentration correcting section 77. Accordingly, the toner concentration with higher accuracy in the developer tank 20 can be obtained, and based on the toner concentration the more appropriate toner concentration can be replenished into the developer tank 20. The toner concentration correcting section 77 can correct the concentration calculation result in accordance with, for example, various kinds of correction parameters. A data table showing a relationship between the detecting sensitivities of the toner concentration detecting section 70 and correction amounts in each of correction parameters is inputted into the storage portion 82. The toner concentration correcting section 77 corrects the calculation result by the toner concentration calculating section 74 based on the data table. Here, there is no limitation to the correction parameter, as long as a parameter affecting the toner concentration in the developer tank 20 is used. Examples of the correction parameters include a decreasing amount of a photosensitive layer on the photoreceptor drum 11, relative humidity in the image forming apparatus 1, and correction value of toner concentration obtained by process control.

The toner concentration correcting section 77 corrects the toner concentration depending on the decreasing amount of the photosensitive layer on the photoreceptor 11 as one of the correction parameters. The decreasing amount of the photosensitive layer on the photoreceptor 11 is obtained by using, for example, the rotation distance accumulating section 78 and the layer decreasing amount calculating section 79.

The rotation distance accumulating section 78 of the developing roller 21 accumulates a total rotation distance from a start of use of the developing roller 21 (its brand-new time) to a present time (a roller total travel distance, cm, hereinafter referred to as simply a "total rotation distance of the developing roller 21"). For example, the rotation distance accumulating section 78 of the developing roller 21 takes out the total rotation number of the developing roller 21*m* and a travel distance (cm) per rotation of the developing roller 21 from the storage portion 82, and accumulates them to obtain the total rotation distance of the developer roller 21. The accumulation result by the rotation distance accumulating section 78 is stored in the storage portion 82. The total rotation number of the developer roller 21 is detected by, for example, a counter (not shown) for detecting a rotation number of the developing roller 21 which is provided in the control unit 38. The detection result by the counter is stored in the storage portion 82. In addition, a travel distance (cm) per rotation of the developing roller 21 is stored in the storage portion 82 in advance. The rotation distance accumulating section 78 of the photoreceptor drum 11 has the same configuration as that of the developing roller 21.

The layer decreasing amount calculating section 79 calculates the decreasing amount of the photosensitive layer according to the calculation result by the rotation distance accumulating section 78 of the developing roller or the photoreceptor drum 11. A fourth data table or a fifth data table is stored in the storage portion 82 in advance. The fourth data table shows a relationship between the total rotation distance of the developing roller 21 (the roller total travel distance, cm) and the decreasing amount of the photosensitive layer. The fifth data table shows a relationship between the total rotation distance (cm) of the photoreceptor drum 11 and the decreasing amount of the photosensitive layer. The layer decreasing amount calculating section 79 takes out the fourth data table and the total rotation distance of the developing roller 21 from the storage portion 82, and obtains the decreasing amount of the photosensitive layer from the total rotation distance based on the fourth data table. Alternatively, the layer decreasing amount calculating section 79 takes out the fifth data table and the total rotation distance of the photoreceptor drum 11 from the storage portion 82, and obtains the decreasing amount of the photosensitive layer from the total rotation distance based on the fifth data table. The calculation result by the layer decreasing amount calculating section 79 is inputted into the storage portion 82.

A sixth data table is stored in the storage portion 82 in advance. The sixth data table shows a relationship between the decreasing amount of the photosensitive layer and a correction value of control voltage value to be applied to the toner concentration detecting section 70. The sixth data table is set under a condition that the speed of printing is the speed of printing a monochrome image. The sixth data table is set with respect to each model of the image forming apparatuses and/or each model of the toner concentration detecting section 70. Incidentally, the decreasing amount of the photosensitive layer is directly proportional to the total rotation distance from a start of use of the developing roller 21 (its brand-new time) to a present time (the roller total travel distance, cm). Therefore, the total rotation distance of the developing roller 21 (the roller total travel distance, cm) and the correction value of the detecting sensitivity of the toner concentration detecting section 70 (the correction value of the control voltage) can be used as the sixth data table. In the embodiment, the data table shown in Table 1 is used as the sixth data table. Control is carried out by adding correction amounts of the control voltage described in the sixth data table to the control voltage values.

TABLE 1

| Area | Roller total travel distance (cm) | Intermittent by 3 sheets | Continuous | Correction amount of control voltage b | c | m | y |
|---|---|---|---|---|---|---|---|
| 1 | -8267 | 200 | 300 | 2 | 1 | 1 | 1 |
| 2 | 8268-16533 | 400 | 600 | 2 | 2 | 2 | 2 |
| 3 | 16534-24800 | 600 | 900 | 2 | 1 | 1 | 1 |
| 4 | 24801-33067 | 800 | 1200 | 2 | 2 | 2 | 2 |
| 5 | 33068-41333 | 1000 | 1500 | 2 | 1 | 1 | 1 |
| 6 | 41334-49600 | 1200 | 1800 | 2 | 2 | 2 | 2 |
| 7 | 49601-57867 | 1400 | 2100 | 2 | 1 | 1 | 1 |
| 8 | 57868-66133 | 1600 | 2400 | 2 | 2 | 2 | 2 |
| 9 | 66134-74400 | 1800 | 2700 | 2 | 1 | 1 | 1 |
| 10 | 74401-82667 | 2000 | 3000 | 2 | 2 | 2 | 2 |
| 11 | 82668-124000 | 3000 | 4500 | 0 | 0 | 0 | 0 |
| 12 | 124001-165334 | 4000 | 6000 | 0 | 0 | 0 | 0 |
| 13 | 165335-206667 | 5000 | 7500 | −2 | −1 | −1 | −1 |
| 14 | 206668-289334 | 7000 | 10500 | −2 | −2 | −2 | −2 |
| 15 | 289335-392667 | 9000 | 14250 | −2 | −1 | −1 | −1 |
| 16 | 392668-516668 | 12500 | 18750 | −2 | −2 | −2 | −2 |
| 17 | 516669-661334 | 16000 | 24000 | −2 | −1 | −1 | −1 |
| 18 | 661335-884535 | 21400 | 32100 | −2 | −2 | −2 | −1 |

TABLE 1-continued

| Area | Roller total travel distance (cm) | Intermittent by 3 sheets | Continuous | Correction amount of control voltage b | c | m | y |
|---|---|---|---|---|---|---|---|
| 19 | 884536-1107735 | 26800 | 40200 | −2 | −1 | −1 | −1 |
| 20 | 1107736-1330935 | 32200 | 48300 | −2 | −2 | −2 | 0 |
| 21 | 1330936-1554136 | 37600 | 56400 | −2 | −1 | −1 | 0 |
| 22 | 1554137-1818670 | 44000 | 66000 | −2 | −2 | −2 | 0 |
| 23 | 1818671-1984003 | 48000 | 72000 | 0 | 0 | 0 | 0 |
| 24 | 1984004-2149337 | 52000 | 78000 | 0 | 0 | 0 | 0 |
| 25 | 2149338-2314670 | 56000 | 84000 | 0 | 0 | 0 | 0 |
| 26 | 2314671-2480004 | 60000 | 90000 | 0 | 0 | 0 | 0 |
| 27 | 2480005-2645338 | 64000 | 96000 | −2 | 0 | 0 | 0 |
| 28 | 2645339-2810671 | 68000 | 102000 | −2 | 0 | 0 | 0 |
| 29 | 2810672-2976005 | 72000 | 108000 | −2 | 0 | 0 | 0 |
| 30 | 2976006-3141338 | 76000 | 114000 | −2 | 0 | 0 | 0 |
| 31 | 3141339-3306672 | 80000 | 120000 | −2 | 0 | 0 | 0 |
| 32 | 3306673-3472006 | 84000 | 126000 | 0 | 0 | 0 | 0 |
| 33 | 3472007-3637339 | 88000 | 132000 | 0 | 0 | 0 | 0 |
| 34 | 3637340-3802673 | 92000 | 138000 | 0 | 0 | 0 | 0 |
| 35 | 3802674-3968006 | 96000 | 144000 | 0 | 0 | 0 | 0 |
| 36 | 3968007-4133340 | 100000 | 150000 | 0 | 0 | 0 | 0 |
| 37 | 4133341- | 104000 | 156000 | 0 | 0 | 0 | 0 |

Incidentally, in Table 1, the correction amount of the control voltage shows a correction value after an AD conversion in each of areas, and is continuously added in accordance with the total rotation distance (the roller total travel distance, cm). For example, in Area 12, when the developer is b, c, or m, a value "+20", which has been obtained by adding each correction amount of control voltage from in Area 1 to in Area 12, is the correction amount of control voltage for the developer b, c or m in Area 12. In a case of the developer y, a value "+15", which has been obtained by adding each of correction amounts of control voltage from in Area 1 to in Area 12, is the correction amount of control voltage for the developer y. Further, in Table 1, the "intermittent by 3 sheets" means a case in which a cycle that "3 sheets of an A4-size sheet are continuously printed and then the image forming apparatus is stopped for 10 seconds" is repeated as an aging. In addition, the "continuous" means a case in which a cycle that "99 sheets of an A4-size sheet are continuously printed" is repeated as an aging without stopping the image forming apparatus. Note that the a ratio of the "intermittent by 3 sheets" to the "continuous" is a relationship of 2:3.

Further, the data in Table 1 are measured by using; as the image forming apparatus, a full-color copying machine (trade name: Modified machine of MX-5500, a two-component developing method, a developing bias voltage: −400 V, manufactured by Sharp Corporation); as the toner concentration detecting section 70, an ATC (Automatic Temperature Compensation) permeability sensor for detecting a toner concentration (trade name: TSO524, manufactured by TDK Corporation, hereinafter referred to as simply an "ATC permeability sensor"); and a two-component developer (a black developer for MX-5500, a toner concentration of 6% by weight, manufactured by Sharp Corporation), when copying a A4-size sheet at a black character print rate of 5%. Data in Table 2 and Table 3 are measured likewise with respect to Table 1.

A seventh data table is stored in the storage portion 82 in advance. The seventh data table shows a relationship between roller total travel distances and correction values of voltage value outputted from the toner concentration detecting section 70, at the speed of printing a monochrome image. At this time, the control voltage to be inputted into the toner concentration detecting section 70 is the control voltage obtained by correcting the reference control voltage based on the sixth data table. Incidentally, a data table may be inputted, which is obtained by previously carrying out an experiment with respect to a relationship the roller total travel distance at the speed of printing a color image and the speed of printing on cardboard, and the correction value of voltage outputted from the toner concentration detecting section 70. However, the relationship at the speed of printing a monochrome image is substantially proportional to the relationship at the speed of printing a color image and the speed of printing on cardboard. Therefore, the first proportional constant $k_1$ should be used for a correlation between the relationship at the speed of printing a monochrome image and the relationship at the speed of printing a color image, and the second proportional constant $k_2$ should be used for a correlation between the relationship at the speed of printing a monochrome image and the relationship at the speed of printing on cardboard. Then, the output voltage corrected based on the sixth data table should be corrected to the output voltage for the speed of printing a color image or the speed of printing on cardboard, according to the speed of printing. Accordingly, the roller total travel distances for a data taking are optionally determined without taking data in the respective roller total travel distances, at the speed of printing a color image and the speed of printing on cardboard, and a data taking is carried out with respect to the roller total travel distances. Accordingly, not only is the substantially accurate correction value obtained, but the setting with respect to each model of the image forming apparatuses is simplified.

Figure 3:
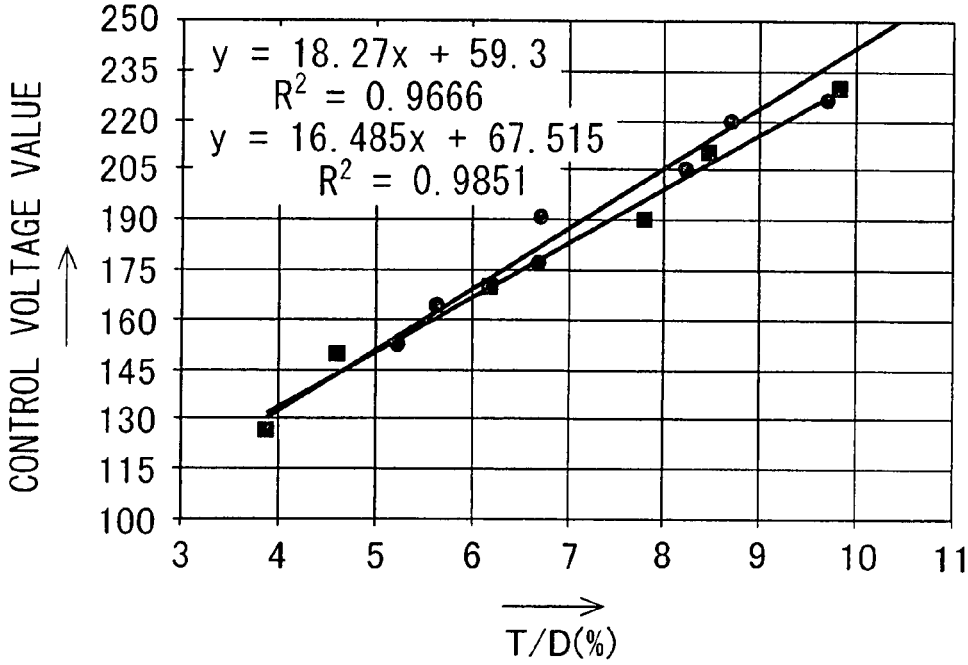
FIG. 3 is a graph illustrating a relationship between a toner concentration and a control voltage value at a monochrome image print speed.
Figure 4:
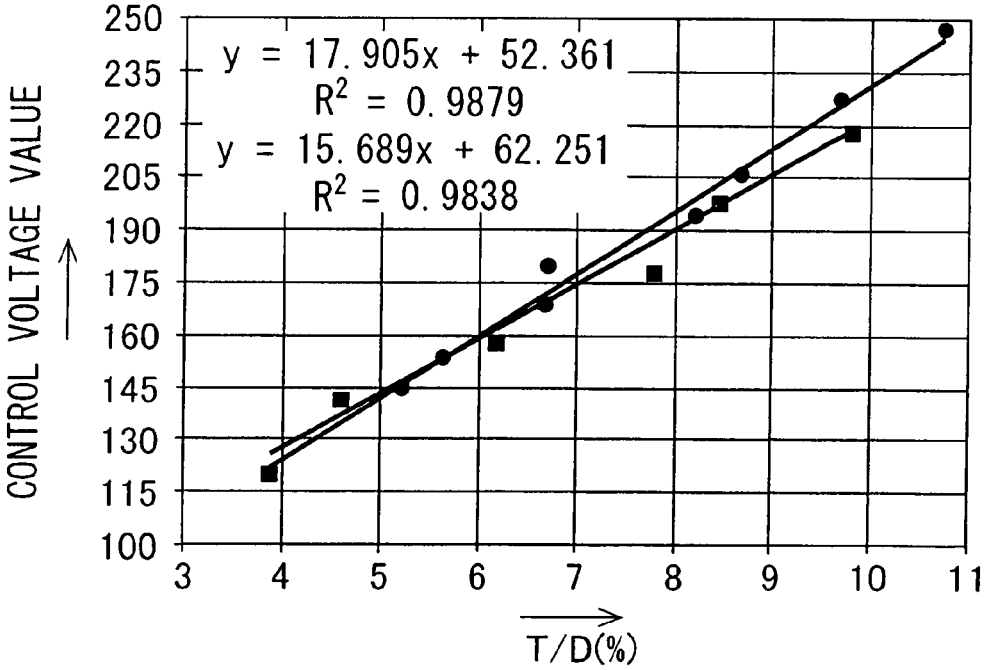
FIG. 4 is a graph illustrating a relationship between the toner concentration and the control voltage value at a color image print speed.
Figure 5:
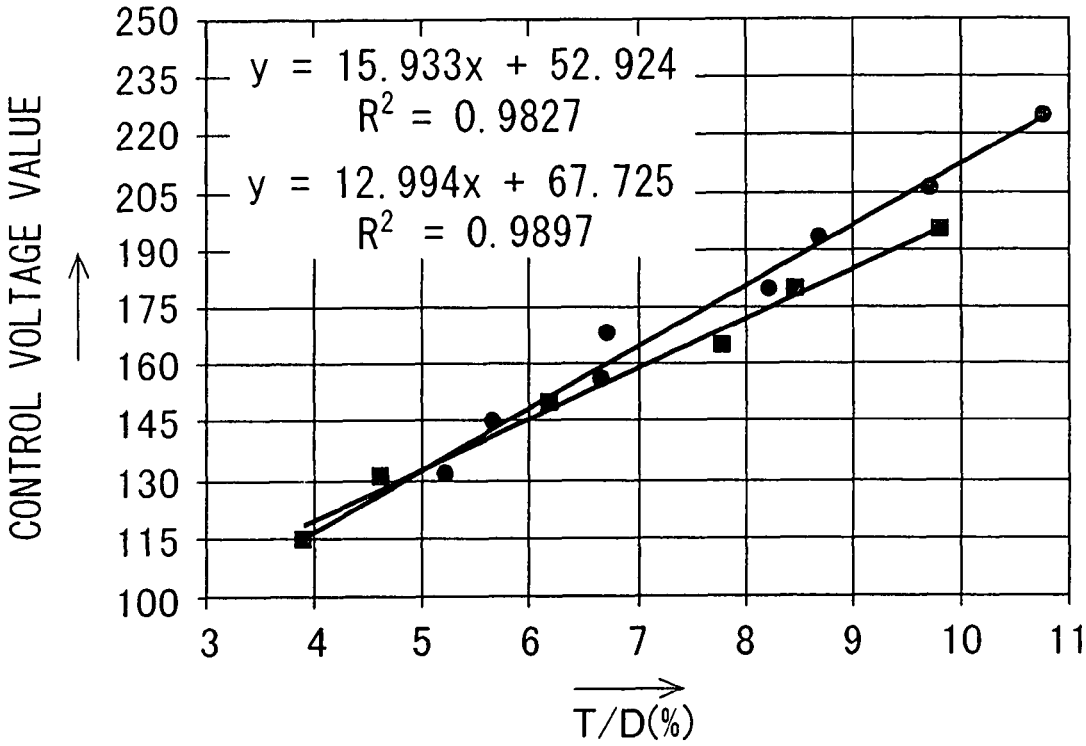
FIG. 5 is a graph illustrating a relationship between the toner concentration and the control voltage value at a cardboard print speed.

In the embodiment, the reference control voltage value and the proportional constants $k_1$ and $k_2$ can be obtained based on a graph shown in FIGS. 3 to 5. FIGS. 3 to 5 are graphs each showing a relationship between the toner concentration (T/D, %) at each of the speeds of printing and control voltage values. In FIGS. 3 to 5, a horizontal axis (an X axis) represents the toner concentration, and a vertical axis (a Y axis) represents the control voltage value. FIGS. 3, 4, and 5 show the relationship at the speed of printing a monochrome image (225 mm/sec), at the one at the speed of printing a color image (167 mm/sec), and the one at the speed of printing on cardboard (83.5 mm/sec). The data shown in FIGS. 3 to 5 are measured by using a commercially available machine (trade name: Modified machine of MX-5500) as the image forming apparatus; an ATC permeability sensor (TSO524) as the toner concentration detecting section 70; and a two-component developer (for MX-5500), when copying a A4-size sheet at a black character print rate of 5%. The ATC permeability sensor has 5 V at an analog voltage in output maximum value. When actually using the ATC permeability sensor, it is necessary to set the digital control voltage value to the toner concentration (T/D, where the T represents weight of the toner contained in the developer, and the D represents weight of the total developer, %), so that the output voltage value is half the output maximum value (2.5 V) in terms of a sensitivity property. In actual control of the ATC permeability sensor, an AD conversion is carried out so that a half of the analog output maximum value (2.5 V) is a setting value (an exponent value) of 128 at a digital value. Therefore, as shown in FIGS. 3 to 5, the control voltage value (a setting value) at which the setting value of the output voltage is 128, is obtained. For example, in a case of the toner concentration of 6% and the speed of printing a monochrome image (225 mm/s), as shown in FIG. 3, the reference control voltage value of "168" is stored in the storage portion 82. Further, in a case of the toner concentration of 6% and the speed of printing a color image (167 mm/s), as shown in FIG. 4, the reference control voltage value of "160" is stored in the storage portion 82. Further, in a case of the toner concentration of 6% and the speed of printing on cardboard (83.5 mm/s), as shown in FIG. 5, the reference control voltage value of "148" is stored in the storage portion 82.

In addition, the proportional constants $k_1$ and $k_2$ are obtained by utilizing a fact that an approximate straight line, which is obtained from the respective plots of a solid square and a solid circle shown in FIGS. 3 to 5 by linear regression using a least-square method, is obtained, as a relative ratio when a gradient of the approximate straight line at the speed of printing a monochrome image is 1. Incidentally, in FIGS. 3 to 5, the plots shown by the solid square represent the control voltage values which are measured by changing the toner concentration of the developer from a low concentration side to a high concentration side. The plots shown by the solid circle represent the control voltage values which are measured by changing the toner concentration of the developer from a high concentration side to a low concentration side. When a gradient of the approximate straight line at the speed of printing a monochrome image shown in FIG. 3 is 1, a gradient of the approximate straight line at the speed of printing a color image shown in FIG. 4 (the proportional constant $k_1$) is 0.97. In more detail, the proportional constant $k_1$ is obtained as follows: $k_1 \cong 0.966$ (rounded to two decimal places)=0.97, by dividing an average of the gradients of the two approximate straight lines shown in FIG. 4 as follows: ((17.905+15.689)/2=16.797) by an average of the gradients of the two approximate straight lines shown in FIG. 3 as follows: ((18.27+16.485)/2=17.378). In addition, a gradient of the approximate straight line at the speed of printing on cardboard (the proportional constant $k_2$) is obtained as 0.83 based on FIGS. 3 and 5 in a similar manner.

The toner concentration correcting section 77 controls in a different manner according to the speed of printing. When the speed of printing a monochrome image is used, the toner concentration correcting section 77 first takes out the total rotation distance of the developing roller 21 (the roller total travel distance, cm) and the sixth data table from the storage portion 82, and determines the correction amount of control voltage with respect to each color of the developer. Then, the toner concentration correcting section takes out the speed of printing and the reference control voltage value with respect to each color from the storage portion 82, and adds the correction amount of control voltage to calculate a correction value of control voltage, and further controls so as to apply the correction value of control voltage to the toner concentration detecting section 70. The toner concentration detecting section 70 outputs a detection result of the toner concentration to the control unit 38 as an output voltage value in response to application of the correction value of control voltage. This output voltage value is stored in the storage portion 82. The toner concentration correcting section 77 takes out the seventh data table from the storage portion 82 to obtain a correction value of the output voltage value from the toner concentration detecting section 70 in the roller total travel distance, and further takes out the output voltage value to correct the output voltage value by the correction value, and outputs the real output voltage value obtained thereby to the toner concentration calculating section 74. In addition, when the speed of printing a color image is used, the "real correction value of control voltage" is obtained by multiplying the correction value of control voltage at the speed of printing a monochrome image by the proportional constant $k_1$, and is outputted to the toner concentration calculating section 74. When the speed of printing on cardboard is used, the "real correction value of control voltage" is obtained by multiplying the correction value of control voltage at the speed of printing a monochrome image by the proportional constant $k_2$, and is outputted to the toner concentration calculating section 74.

Hereinafter, the toner concentration is determined and a toner replenishing operation is carried out in a similar manner as described above.

Moreover, the toner concentration correcting section 77 corrects the toner concentration depending on a relative humidity inside the image forming apparatus 1 (hereinafter, referred to as simply a "relative humidity") as one of the correction parameters. This correction is carried out by using, for example, the humidity detecting section 71. The humidity detecting section 71 detects the relative humidity. The detection result is stored in the storage portion 82. In addition, an eighth data table showing a relationship between relative humidities and correction values of control voltage to be inputted to the toner concentration detecting section 70 (correction value of control voltage based on humidity) is stored in the storage portion 82 in advance. The eighth data table is set under a condition that the speed of printing is the speed of printing a monochrome image. The eighth data table is set with respect to each model of the image forming apparatuses and/or each model of the toner concentration detecting sections 70. In the embodiment, the data table shown in Table 2 is used as the eighth data table. In Table 2, an item of a "humidity sensor output" shows an analog voltage value in a unit of V, and a digital AD value after an AD conversion of the analog voltage value. The AD value is stored in the storage portion 82. Note that the relative humidity is classified into fourteen areas.

TABLE 2

| Humidity Area | Relative humidity (%) | Humidity sensor output (V)/AD conversion value | Correction amount of control voltage based on humidity b | c | m | y |
|---|---|---|---|---|---|---|
| 1 | -9.9 | -0.70/-54 | 0 | 0 | 0 | 0 |
| 2 | 10-14.99 | 0.71-0.81/55-62 | −4 | −4 | −4 | −3 |
| 3 | 15-19.99 | 0.82-0.91/63-70 | −8 | −8 | −8 | −6 |
| 4 | 20-25.18 | 0.92-1.09/71-84 | −12 | −12 | −12 | −9 |
| 5 | 25.19-29.99 | 1.10-1.26/85-97 | −16 | −16 | −16 | −12 |
| 6 | 30-34.99 | 1.27-1.44/98-111 | −18 | −18 | −18 | −15 |
| 7 | 35-39.99 | 1.45-1.62/112-125 | −20 | −20 | −20 | −18 |
| 8 | 40-49.99 | 1.63-1.96/126-151 | −20 | −20 | −20 | −18 |
| 9 | 50-59.99 | 1.97-2.29/152-177 | −20 | −20 | −20 | 18 |
| 10 | 60-64.99 | 2.30-2.45/178-189 | −23 | −23 | −23 | −20 |
| 11 | 65-69.99 | 2.46-2.60/190-201 | −28 | −28 | −28 | −22 |
| 12 | 70-75.21 | 2.61-2.76/202-213 | −33 | −33 | −33 | −25 |
| 13 | 75.22-79.99 | 2.77-2.90/214-224 | −38 | −38 | −38 | −28 |
| 14 | 80- | 2.91-/225- | −43 | −43 | −43 | −30 |

In addition, a ninth data table is stored in the storage portion 82. The ninth data table is a data table showing a relationship between relative humidities and correction values of the output voltage value to be outputted from the toner concentration detecting section 70 as a detection result. At this time, the control voltage value to be inputted to the toner concentration detecting section 70 is the correction value of control voltage obtained by correcting the reference control voltage value based on the eighth data table (the data table of Table 2). Here, likewise with respect to the control based on the decreasing amount of the photosensitive layer on the photoreceptor, the proportional constant $k_1$ for converting the correction value at the speed of printing a monochrome image into the correction value of control voltage at the speed of printing a color image is used instead of storing the data tables at the speed of printing a color image and the speed of printing on cardboard. Moreover, the proportional constant $k_2$ for converting the correction value of control voltage at the speed of printing a monochrome image into the correction value at the speed of printing on cardboard is used.

The toner concentration correcting section 77 controls in a different manner according to the speed of printing. When the speed of printing a monochrome image is used, the toner concentration correcting section 77 first takes out the relative humidity and the eighth data table from the storage portion 82 to determine the correction amount of control voltage based on humidity. At this time, as in the case in which the correction parameter is the decreasing amount of the photosensitive layer on the photoreceptor, the correction amount of control voltage based on humidity in the area is a value obtained by accumulating the correction value in each area until the above-mentioned area. Then, the toner concentration correcting section 77 takes out the reference control voltage value from the storage portion 82 according to the speed of printing and the color, and adds the correction amount of control voltage based on humidity to this reference control voltage value to calculate the correction value of control voltage, and controls so that this correction value of control voltage is applied to the toner concentration detecting section 70. The toner concentration detecting section 70 outputs a detection result of the toner concentration to the control unit 38 as an output voltage value, in response to application of this correction value of control voltage. This output voltage value is stored in the storage portion 82. The toner concentration correcting section 77 takes out the ninth data table from the storage portion 82 to obtain the correction value of the output voltage value from the toner concentration detecting section 70 at the relative humidity, and further takes out the output voltage value to correct the output voltage value using the correction value, to obtain the real output voltage value. When the speed of printing a color image is used, the correction amount of control voltage based on humidity at the speed of printing a monochrome image is multiplied by the proportional constant $k_1$. When the speed of printing on cardboard is used, the correction amount of control voltage based on humidity at the speed of printing a monochrome image is multiplied by the proportional constant $k_2$. The real correction value of control voltage obtained as described above is outputted to the toner concentration calculating section 74. Hereinafter, the toner concentration is determined and the toner replenishing operation is carried out, in a similar manner as described above.

Further, the toner concentration correcting section 77 corrects the toner concentration according to process control as one of the correction parameter. This correction is carried out by using, for example, the patch forming section 80 and the patch concentration correcting section. The patch forming section 80 controls the toner image forming section 2 to form a toner patch on the surface of the photoreceptor drum 1 as a toner image for detecting the toner concentration. As the toner patch, for example, eight patterns of square having a side of about 8 cm are formed. The patch forming section 80 changes a forming condition to form the plurality of toner patches in which the toner concentration, that is, the patch concentration is continuously changed. It is preferable that the plurality of toner patches are formed corresponding to a print concentration capable of being set in the image forming apparatus 1. Here, the forming conditions include a developing bias voltage value to be applied to the developing roller 21, a charge voltage value to be applied to the surface of the photoreceptor drum 11 (charge potential), and a charge voltage value of an electrostatic latent image to be formed on the surface of the photoreceptor drum 11 by the exposure unit 16 (exposure potential). Among these conditions, one or two or more conditions are fixed to a constant value, and the other conditions are as appropriate changed in increments of a constant amount. Accordingly, the plurality of toner patches in which the patch concentration is continuously changed are formed. The plurality of toner patches should be formed by keeping the charge potential and the exposure potential fixed, and changing the developing bias voltage value in increments of a constant amount. The forming conditions (the developing bias voltage value, etc.) of the plurality of toner patches are stored in the storage portion 82.

The patch concentration detecting section 72 detects the patch concentration of the toner patch on the surface of the photoreceptor drum 11. A detection result by the patch concentration detecting section 72 (hereinafter, referred to as a "patch concentration detection result") is stored in the storage portion 82. In the storage portion 82, a reference patch concentration which is determined upon a design of the image forming apparatus 1 is stored in advance. The reference patch concentrations are stored as, for example, a reference reflected light amount in a case of a monochrome image, and a scattered-light amount in a case of a color image, respectively. After the patch concentration has been detected by the patch concentration detecting section 72, the toner patch is removed from the surface of the photoreceptor drum 11 by the cleaning unit 14. The control unit 38 takes out a detection result of the patch concentration and the reference patch concentration from the storage portion 82 to compare them, reads out the developing bias voltage value which has been used for forming the toner patch having the patch concentration closest to the reference patch concentration to obtain a difference from the developing bias voltage value in the reference patch concentration, and stores the difference as a correction amount of developing bias in the storage portion 82.

Further, in the storage portion 82, a tenth data table is stored in advance. The tenth data table shows a relationship between correction amounts of developing bias and correction amounts of control voltage based on process control to be applied to the toner concentration detecting section 70. The tenth data table is set under a condition that the speed of printing is the speed of printing a monochrome image. The tenth data table is set with respect to each model of the image forming apparatuses and/or each model of the toner concentration detecting section 70. In the embodiment, the data table shown in Table 3 is used as the tenth data table. In Table 3, a "DVB range" represents a developing bias value to be applied in a process control zone out of an initial setting range of the developing bias (DVB) (450±20 V).

TABLE 3

| Process control | | Correction amount of control voltage based on process control (V) | | | |
|---|---|---|---|---|---|
| zone | DVB range | b | c | m | y |
| 1 | 651- | 3 | 3 | 3 | 3 |
| 2 | 601-650 | 3 | 3 | 3 | 3 |
| 3 | 551-600 | 2 | 2 | 2 | 2 |
| 4 | 491-550 | 2 | 2 | 2 | 2 |
| | 410-490 | 0 | 0 | 0 | 0 |
| 5 | 350-409 | −3 | −3 | −3 | −3 |
| 6 | 300-349 | −5 | −5 | −5 | −5 |
| 7 | 250-299 | −5 | −5 | −5 | −5 |
| 8 | -249 | −5 | −5 | −5 | −5 |

Further, in the storage portion 82, an eleventh data table is stored. The eleventh data table shows a relationship between correction amounts of developing bias at the speed of printing a monochrome image and correction values of the output voltage value to be outputted from the toner concentration detecting section 70. At this time, the control voltage value to be inputted to the toner concentration detecting section 70 is the correction value of control voltage obtained by correcting the reference control voltage value based on the tenth data table. Here, likewise with respect to the control based on the decreasing amount of the photosensitive layer on the photoreceptor, instead of storing the data tables at the speed of printing a color image and the speed of printing on cardboard, the proportional constant $k_1$ for converting the correction value at the speed of printing a monochrome image into the correction value of control voltage at the speed of printing a color image is used, and the proportional constant $k_2$ for converting the correction value of control voltage at the speed of printing a monochrome image into the correction value at the speed of printing on cardboard is used.

The toner concentration correcting section 77 controls in a different manner according to the speed of printing. When the speed of printing a monochrome image is used, the toner concentration correcting section 77 first takes out the correction amount of developing bias and the tenth data table from the storage portion 82 to determine the correction amount of control voltage based on process control. Then, the toner concentration correcting section 77 takes out the reference control voltage value from the storage portion 82 according to the color, and adds the correction amount of control voltage based on process control to this reference control voltage value to calculate the correction value of control voltage, and applies this correction value of control voltage to the toner concentration detecting section 70. The toner concentration detecting section 70 outputs a detection result of the toner concentration to the control unit 38 as an output voltage value, in response to application of this correction value of control voltage. This output voltage value is stored in the storage portion 82. The toner concentration correcting section 77 takes out the eleventh data table from the storage portion 82 to obtain the correction value of the output voltage value from the toner concentration detecting section 70 at the relative humidity, and further takes out the output voltage value to correct the output voltage value using the correction value, to obtain the real output voltage value. When the speed of printing a color image is used, the correction amount of control voltage based on process control at the speed of printing a monochrome image is multiplied by the proportional constant $k_1$. When the speed of printing on cardboard is used, the correction amount of control voltage based on process control at the speed of printing a monochrome image is multiplied by the proportional constant $k_2$. The real correction value of control voltage obtained as described above is outputted to the toner concentration calculating section 74. Hereinafter, the toner concentration is determined and the toner replenishing operation is carried out, in a similar manner as described above.

In the embodiment, the toner concentration correcting section 77 corrects the above-described 3 correction parameters, collectively, and carries out a correction so as to add the correction amount of control voltage in each correction parameter. In this case, the proportional constant at the speed of printing a color image or at the speed of printing on cardboard is determined based on the control voltage value at the speed of printing a monochrome image, so that the 3 correction parameters are collectively used, and the correction amount of control voltage is calculated based on the proportional constant. Incidentally, when a more accurate correction is required, it is preferable that the proportional constant of the correction amount of control voltage at the speed of printing a color image or at the speed of printing on cardboard is determined based on the correction amount of control voltage at the speed of printing a monochrome image, with respect to each correction parameter, and the correction is carried out by using a value obtained by adding the correction amount of control voltage with respect to each correction parameter.

EXAMPLES

Hereinafter, the technology is described specifically, with reference to examples and comparative examples.

Examples 1 to 11 and Comparative Examples 1 to 4

The following image forming apparatus, toner concentration detecting section, and developer were used.

Image Forming Apparatus:

A full-color copying machine (trade name: Modified machine of MX-5500, manufactured by Sharp Corporation) was used. A developing bias voltage value in the image forming apparatus is −400 V. In addition, a print speed, and a proportional constant and a reference control voltage value at each print speed in the image forming apparatus are set as shown in Table 4.

TABLE 4

| | Speed of printing mm/sec | Proportional constant | Reference control voltage value V |
|---|---|---|---|
| Monochrome image print | 225 | 1 | 168 |
| Color image print | 167 | 0.97 | 160 |
| Cardboard print | 83.5 | 0.83 | 148 |

Toner Concentration Detecting Section:

An ATC permeability sensor (trade name: TSO524, manufactured by TDK Corporation) was used. This ATC permeability sensor is set so that a maximum value of a voltage to be outputted by application of a control voltage is 5 V.

Developer:

A two-component developer (for MX-5500, black, a toner concentration of 6% by weight, manufactured by Sharp Corporation) was used.

In Tables 5 and 6 described later, a control voltage value $A_1$ is obtained before correction is obtained by adding a correction amount of control voltage (a sum of correction amounts of layer decreasing amount, relative humidity, and process control) to a reference control voltage value $A_0$. Further, a correction value of control voltage $B_0$ is evaluated according to the following expression:

$$B_0=B_1+(A_1-A_0)\times K_0$$

After copying an original sheet having a black character print rate of 5% onto a A4-size recording sheet under the condition described above, an eventual toner concentration in a developer which was stored in a developer tank of the image forming apparatus was investigated. The result is shown in Tables 5 and 6. In the image forming apparatus, it is revealed that toner concentration control is appropriately carried out while changing a speed of printing, allowing the initial toner concentration to be maintained. On the other hand, in the comparative examples 1 to 4 in which a proportional constant $K_0$ is not set with respect to each of speeds of printing, a toner replenishment becomes inaccurate while changing the speed of printing, increasing the toner concentration to a level larger than that in an initial stage.

TABLE 5

| | | | Example | | | Comparative example | | | |
|---|---|---|---|---|---|---|---|---|---|
| | | | 1 | 2 | 3 | 1 | 2 | 3 | 4 |
| Correction parameter | Layer decreasing amount (sheets) | | 301 | 301 | 301 | 301 | 301 | 301 | 301 |
| | Relative humidity (%) | | <10 | 55 | 72 | <10 | 55 | 55 | 72 |
| | Process control | | — | — | — | — | — | — | — |
| Correction amount of control voltage | Correction amount of layer decreasing amount | | 4 | 4 | 4 | 4 | 4 | 4 | 4 |
| | Correction amount of relative humidity | | 0 | −20 | −33 | 0 | −20 | −20 | −33 |
| | Correction amount of process control | | — | — | — | — | — | — | — |
| Speed of printing | Before change (mm/sec) | | 225 | 225 | 225 | 225 | 225 | 225 | 225 |
| | After change (mm/sec) | | 167 | 83.5 | 83.5 | 167 | 83.5 | 167 | 83.5 |
| Control voltage | Reference control voltage value | Before change $A_0$ | 168 | 168 | 168 | 168 | 168 | 168 | 168 |
| | | After change $B_0$ | 160 | 148 | 148 | — | — | 160 | 148 |
| | Proportional constant after change $K_0$ | | 0.97 | 0.83 | 0.83 | — | — | 1 | 1 |
| | Control voltage value | Before correction $A_1$ | 172 | 152 | 139 | 172 | 168 | 152 | 139 |
| | | After correction $B_1$ | 164 | 135 | 124 | — | — | 144 | 119 |
| Toner concentration (% by weight) | | | 6.0 | 6.0 | 6.0 | 6.3 | 6.7 | 6.2 | 6.2 |
| Remarks | | | — | — | — | *1 | *2 | *3 | *3 |

*1 (Comparative example 1): Only the correction value of control voltage for the decreasing amount (a decreasing amount of a photosensitive layer) as a correction parameter is set. In addition, the reference control voltage at each of speeds of printing is not set. Therefore, an accurate correction is not achieved when the speed of printing is changed.

*2 (Comparative example 2): The correction values of control voltage for the decreasing amount (a decreasing amount of a photosensitive layer) and the relative humidity as the correction parameter are set, but the reference control voltage at each of speeds of printing is not set. Therefore, an accurate correction is not achieved when the speed of printing is changed.

*3 (Comparative examples 3 and 4): The correction values of control voltage for the decreasing amount (a decreasing amount of a photosensitive layer) and the relative humidity as the correction parameter are set, but the proportional constant with respect to each of speeds of printing based on a speed of printing a monochrome image is not set. Therefore, an accurate correction is not achieved when the speed of printing is changed.

TABLE 6

| | | | Example | | | | | | | |
|---|---|---|---|---|---|---|---|---|---|---|
| | | | 4 | 5 | 6 | 7 | 8 | 9 | 10 | 11 |
| Correction parameter | Layer decreasing amount (sheets) | | 24K | 24K | 24K | 84K | 84K | 84K | 120K | 120K |
| | Relative humidity (%) | | 55 | 55 | 72 | 55 | 55 | 72 | 55 | 72 |
| | Process control | | — | ON | ON | — | ON | ON | ON | ON |
| Correction amount of control voltage | Correction amount of layer decreasing amount | | 10 | 10 | 10 | 0 | 0 | 0 | −10 | −10 |
| | Correction amount of relative humidity | | −20 | −20 | −33 | −20 | −20 | −33 | −20 | −33 |
| | Correction amount of process control | | 0 | 1 | 1 | 0 | 2 | 2 | 1 | 1 |
| Speed of printing | Before change (mm/sec) | | 225 | 225 | 225 | 225 | 225 | 225 | 225 | 225 |
| | After change (mm/sec) | | 83.5 | 83.5 | 83.5 | 83.5 | 83.5 | 83.5 | 83.5 | 83.5 |
| Control voltage | Reference control voltage value | Before change $A_0$ | 168 | 168 | 168 | 168 | 168 | 168 | 168 | 168 |
| | | After change $B_0$ | 148 | 148 | 148 | 148 | 148 | 148 | 148 | 148 |
| | Proportional constant after change $K_0$ | | | 0.83 | 0.83 | 0.83 | 0.83 | 0.83 | 0.83 | 0.83 |
| | Control voltage value | Before correction $A_1$ | 158 | 159 | 146 | 148 | 150 | 137 | 139 | 126 |
| | | After correction $B_1$ | 140 | 141 | 130 | 131 | 133 | 122 | 124 | 113 |
| Toner concentration | % by weight | | 6.0 | 5.9 | 5.9 | 6.1 | 6.0 | 6.1 | 5.9 | 6.1 |
| | Number of times of printing during measurement | | 32K | 32K | 32K | 89K | 89K | 89K | 125K | 125K |

The technology may be embodied in other specific forms without departing from the spirit or essential characteristics thereof. The present embodiments are therefore to be considered in all respects as illustrative and not restrictive, the scope of the technology being indicated by the appended claims rather than by the foregoing description and all changes which come within the meaning and a range of equivalency of the claims are therefore intended to be embraced therein.

What is claimed is:

1. An image forming apparatus for electrophotographically forming an image, comprising:

an image forming section for printing the toner image on a recording medium to form an image, the image forming section including a photoreceptor having a photosensitive layer for forming an electrostatic latent image on a surface thereof, and a developing device including a developing roller for supplying a toner to the electrostatic latent image on the surface of the photoreceptor to form a toner image, and a developer tank for storing a two-component developer containing a toner;

a toner concentration detecting section for detecting a toner concentration in the developer tank;

a printing speed switching section for switching a speed of printing an image formed by the image forming section;

a toner concentration calculating section for calculating a toner concentration in the developer tank from a detection result by the toner concentration detecting section, according to the speed of printing an image;

a toner replenishment control section for replenishing the toner into the developer tank according to a calculation result by the toner concentration calculating section;

a sensitivity switching section for switching a detecting sensitivity of the toner concentration detecting section depending on the print speed of an image; and a toner concentration correcting section that corrects the calculation result generated by the toner concentration calculating section based on a thickness of the photosensitive layer on the photoreceptor of the image forming section.

2. The image forming apparatus of claim 1, wherein the image forming section forms a monochrome image or a color image.

3. The image forming apparatus of claim 1, wherein the printing speed switching section carries out switching of speed of printing among speed of printing a monochrome image, speed of printing a color image and speed of printing on cardboard.

4. The image forming apparatus of claim 1, wherein the toner concentration correcting section corrects the calculation result generated by the toner concentration calculating section, based on a data table showing a relationship between detecting sensitivities of the toner concentration detecting section and correction amounts of a correction parameter that is based on a thickness of the photosensitive layer on the photoreceptor of the image forming section.

5. The image forming apparatus of claim 4, wherein the correction parameter is also based on a correction value of toner concentration obtained by process control.

6. The image forming apparatus of claim 1, wherein the toner concentration correcting section comprises:

a rotation distance accumulating section for accumulating a total rotation distance of a developing roller since the developing roller has been started to be used; and a layer decreasing amount calculating section for calculating an amount that a thickness of the photosensitive layer on the photoreceptor has decreased, according to an accumulation result by the rotation distance accumulating section, wherein the toner concentration correcting section corrects the detection result generated by the toner concentration detecting section according to a calculation result generated by the layer decreasing amount calculating section.

7. The image forming apparatus of claim 1, further comprising a humidity detecting section for detecting a relative humidity within the image forming section, wherein the toner concentration correcting section corrects the detection result generated by the toner concentration detecting section according to a detection result generated by the humidity detecting section.

8. The image forming apparatus of claim 1, further comprising:

a patch forming section for controlling the image forming section so as to form a plurality of toner patches on the photoreceptor of which the toner concentrations are continuously changing; and a patch concentration detecting section for detecting patch concentrations which are toner concentrations of the plurality of toner patches formed on the photoreceptor, wherein the toner concentration correcting section corrects the detection result generated by the toner concentration detecting section according to a detection result by the patch concentration detecting section.

9. The image forming apparatus of claim 1, wherein the toner concentration correcting section corrects the calculation result generated by the toner concentration calculating section based on an amount by which a thickness of the photosensitive layer on the photoreceptor has decreased since the photoreceptor started operating.

10. The image forming apparatus of claim 9, wherein the amount by which the thickness of the photosensitive layer on the photoreceptor has decreased is estimated based on the number of times the photoreceptor has rotated since the photoreceptor started operating.

11. The image forming apparatus of claim 9, wherein the amount by which the thickness of the photosensitive layer on the photoreceptor has decreased is estimated based on the number of times that the developing roller of the image forming section has rotated since the developing roller started operating.

12. An image forming apparatus for electrophotographically forming an image, comprising:

an image forming section for printing the toner image on a recording medium to form an image, the image forming section including a photoreceptor having a photosensitive layer for forming an electrostatic latent image on a surface thereof, and a developing device including a developing roller for supplying a toner to the electrostatic latent image on the surface of the photoreceptor to form a toner image, and a developer tank for storing a two-component developer containing a toner;

a toner concentration detecting section for detecting a toner concentration in the developer tank;

a printing speed switching section for switching a speed of printing an image formed by the image forming section;

a toner concentration calculating section for calculating a toner concentration in the developer tank from a detection result generated by the toner concentration detecting section, according to the speed of printing an image;

a toner replenishment control section for replenishing the toner into the developer tank according to a calculation result generated by the toner concentration calculating section;

a sensitivity switching section for switching a detecting sensitivity of the toner concentration detecting section depending on the print speed of an image; and a toner concentration correcting section that corrects the calculation result generated by the toner concentration calculating section based on densities of test patches of toner that are formed on the photoreceptor.

13. The image forming apparatus of claim 12, further comprising:

a toner test patch forming section for controlling the image forming section so as to form a plurality of toner test patches on the photoreceptor, where a toner concentration of the toner test patches is continuously changing; and a toner test patch concentration detecting section for detecting toner concentrations of the plurality of toner test patches formed on the photoreceptor, wherein the toner concentration correcting section corrects the detection result generated by the toner concentration detecting section according to a detection result generated by the toner test patch concentration detecting section.

* * * * *